US006988688B2

(12) United States Patent
Reinke et al.

(10) Patent No.: US 6,988,688 B2
(45) Date of Patent: Jan. 24, 2006

(54) WEB WINDING APPARATUS HAVING TRAVELING, GIMBALED CINCH ROLLER AND WINDING METHOD

(75) Inventors: Stephen M. Reinke, Rochester, NY (US); William C. Lebbon, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 28 days.

(21) Appl. No.: 10/637,198

(22) Filed: Aug. 8, 2003

(65) Prior Publication Data

US 2005/0029389 A1 Feb. 10, 2005

(51) Int. Cl.
*B65H 19/28* (2006.01)

(52) U.S. Cl. ..... 242/532; 242/532.7; 242/547

(58) Field of Classification Search ..... 242/532, 242/532.2, 532.3, 532.7, 547, 332.7
See application file for complete search history.

(56) References Cited

U.S. PATENT DOCUMENTS

| | | | | |
|---|---|---|---|---|
| 2,989,265 | A * | 6/1961 | Selsted | 226/196.1 |
| 3,712,554 | A * | 1/1973 | Lorenzini et al. | 242/415.1 |
| 4,697,755 | A * | 10/1987 | Kataoka | 242/534 |
| 5,248,107 | A * | 9/1993 | Sumida et al. | 242/532 |
| 5,256,232 | A * | 10/1993 | Fuss et al. | 156/187 |
| 5,386,950 | A * | 2/1995 | Abt | 242/532 |
| 5,639,039 | A | 6/1997 | Ohno et al. | |
| 5,690,264 | A * | 11/1997 | Distefano et al. | 226/187 |
| 6,082,659 | A * | 7/2000 | Sankaran et al. | 242/532 |

FOREIGN PATENT DOCUMENTS

DD 231209 A3 12/1985

OTHER PUBLICATIONS

Patent Abstracts of Japan, vol. 0145, No. 70 (M-1060), Dec. 18, 1990 & JP 2 243449 A (Fuji Elelctrochem Co Ltd), Sep. 27, 1990 Abstract.
Patent Abstracts of Japan, vol. 2000, No. 06, Sep. 22, 2000 & JP 2000 086028A (Fuji Kiki Kogyo KK), Abstract.

* cited by examiner

*Primary Examiner*—Emmanuel Marcelo
(74) *Attorney, Agent, or Firm*—Robert Luke Walker

(57) ABSTRACT

In winding methods, a primary nip formed against a web defines continuing and leading web portions. A secondary nip is formed against and moved along the leading portion, from an outfeed side of the primary nip to an infeed side. The continuing portion and a free end of the leading portion are then simultaneously advanced into the primary nip. Winding apparatus has a winding spindle and builder roller that rotate about parallel winding and builder roller axes, respectively. An axle defines a guide axis and carries a cinch roller that rotates about the guide axis. The axle pivots between first and second orientations, in which the guide axis parallels and is transverse to the winding axis, respectively. The axle moves in the first orientation, in an incomplete orbit about the winding spindle from a start to a rotated position, both adjacent the builder roller, and returns in the second orientation.

23 Claims, 37 Drawing Sheets

WEB WINDING APPARATUS HAVING TRAVELING, GIMBALED CINCH ROLLER AND WINDING METHOD

CROSS REFERENCE TO RELATED APPLICATIONS

Reference is made to commonly assigned, co-pending U.S. patent application Ser. No. 10/460,552, entitled: WINDING APPARATUS HAVING BERNOULLI GUIDE CHUTE LEADING INTO ROLLER-CORE NIP AND METHOD, filed Jun. 12, 2003, in the name of Joseph A. Watkins et al.

FIELD OF THE INVENTION

The invention relates to equipment and methods for winding webs and more particularly relates to a film winder having a traveling, gimbaled cinch roller and winding method.

BACKGROUND OF THE INVENTION

Automated equipment has long been available to wind webs of photographic film, paper, and other materials tightly about cores. The web is commonly wound onto a core through a nip between the core or growing web roll and another roller. This helps wind the film tightly. The winding mechanisms include provisions allowing for growth of the web roll. U.S. Pat. No. 4,697,755 discloses a mechanism in which a core is pivoted as the size of the web roll changes. U.S. Pat. No. 3,712,554 discloses a winding mechanism in which a builder roller is pivoted. U.S. Pat. No. 5,256,232 translates a builder roller on a slidable carriage. The builder roller also pivots. This approach also has the advantage of allowing separate adjustment of tension on the web and pressure at the nip. This approach uses an idler roller to turn the web and direct the web onto the builder roller.

Prior to winding, the web is cinched onto the core. This can be done by inserting the free end of the web into a slot in the core, but this can lead to deformation or damage to the end of the web. This is undesirable in some uses, such as film cinematography, in which the free end of the film can have otherwise usable images. The cinching can be provided without the use of a slot or the like, by gripping the leading portion of the web prior to and during the winding of an initial turn. This adds complexity in that the elements used to initially grip the leading portion of the film cannot be left in positions that would interfere with the growing web roll.

U.S. Pat. No. 5,248,107 discloses a film winding apparatus, in which a core is supported on a pair of drums and is held in place by a rider roller. For cinching, a nip roller is brought into contact with the web to hold the web in position. The leading portion is then wrapped around the core by a wrapping table, a slide roller, and a wrapping roller. The wrapping table and slide roller are first moved vertically. The slide roller is then moved horizontally to push the web against the core. The wrapping roller is then brought toward the web to push the web against the core. The wrapping roller is then rolled circumferentially around 45 degrees of the core to wrap that part of the leading portion against the core. The nip roller, wrapping table, slide roller, and wrapping roller are all moved to their original positions after cinching. This approach uses many parts and moves those parts in a complex manner.

U.S. Pat. Nos. 2,989,265 and 5,690,264 disclose apparatus having center pivoted web rollers.

It would thus be desirable to provide improved winding apparatus and methods that cinch with little or no damage to the free end of the web, in a way that is comparable with a carriage mounted builder roller.

SUMMARY OF THE INVENTION

The invention is defined by the claims. The invention, in broader aspects, provides winding methods and apparatus. In the methods, a primary nip is formed against a web. The primary nip defines continuing and leading portions of the web. A secondary nip is formed against and moved along the leading portion, from an outfeed side of the primary nip to an infeed side. The continuing portion and a free end of the leading portion are then simultaneously advanced into the primary nip. Winding apparatus has a winding spindle and builder roller that rotate about parallel winding and builder roller axes, respectively. An axle defines a guide axis and carries a cinch roller that rotates about the guide axis. The axle pivots between first and second orientations, in which the guide axis parallels and is transverse to the winding axis, respectively. The axle moves in the first orientation, in an incomplete orbit about the winding spindle from a start to a rotated position, both adjacent the builder roller, and returns in the second orientation.

It is an advantageous effect of the invention that improved winding apparatus and methods are provided that cinch with little or no damage to the free end of the web, in a way that is comparable with a carriage mounted builder roller.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying figures wherein:

(FIGS. 4–21 are presented in sequential order, except as indicated.)

FIG. 5 is a partial enlargement of the view of FIG. 4.

FIG. 6 is the same view as FIG. 5, but the apparatus is shown following the completion of threading. The carriage and builder roller are in the standby position. The carrier and guide assembly are in the start position. The guide assembly is in the second orientation.

FIG. 7 is a partial front view of the apparatus as shown in FIG. 6.

FIG. 8 is the same view as FIG. 5, but the apparatus is shown following the translation of the carriage and builder roller to the forward position. The builder roller is biased against the web and winding core. The carrier and guide assembly are in the start position. The guide assembly is in the second orientation.

FIG. 9 is a partial front view of the apparatus as shown in FIG. 8.

FIG. 10 is the same view as FIG. 5, but the guide assembly is pivoted to the first orientation, in which the cinch roller and winding core define the secondary nip. The carrier and guide assembly remain in the start position.

FIG. 11 is a partial enlargement of the view of FIG. 10.

FIG. 12 is a partial front view of the apparatus as shown in FIG. 10.

FIG. 13 is the same view as FIG. 5, but following the traveling of the secondary nip in an incomplete orbit around the winding core. The guide assembly remains in the first orientation. The carrier and guide assembly are in the rotated position.

FIG. 14 is a partial enlargement of the view of FIG. 13.

FIG. 15 is a partial front view of the apparatus as shown in FIG. 13.

FIG. 16 is substantially the same view as FIG. 11, but following the completion of cinching. The guide assembly is in the second orientation. The carrier and guide assembly are in the rotated position.

FIG. 17 is a partial front view of the apparatus as shown in FIG. 16.

FIG. 18 is the same view as FIG. 11, but during winding. The carrier is in the start position. The guide assembly is in the second orientation.

FIG. 19 is the same view as FIG. 17, but following the completion of winding and before web cut off.

FIG. 20 is the same view as FIG. 10, but following completion of winding, cut off of the web, and withdrawal of the carriage and builder roller to the standby position.

FIG. 21 is the same view as FIG. 17, but following the removal of the completed web roll.

DETAILED DESCRIPTION OF THE INVENTION

The term "web" is used herein to refer to a thin membrane of photographic film, coated or uncoated paper or plastic, or other material. The web has a uniform transverse dimension, within limits required for a particular use. The length of the web is determinate or indeterminate, as appropriate for a particular use. For example, the web can be a short sheet of known length or a long roll that is cut to a particular length, as needed.

The term "rotary element" is used herein to refer to a rotating structure that is capable of receiving the web in a single turn or portion of a turn, or in a wrap or coil having multiple turns. For example, the "rotary element" can be a roller, a mandrel, or a core or spool that can be removably mounted on a spindle. The invention is generally discussed herein in terms of embodiments in which the rotating element is a core that is mounted on a spindle.

The term "fixed" and like terms are used herein in the sense of an immobile rather than movable mounting.

Figure 1:
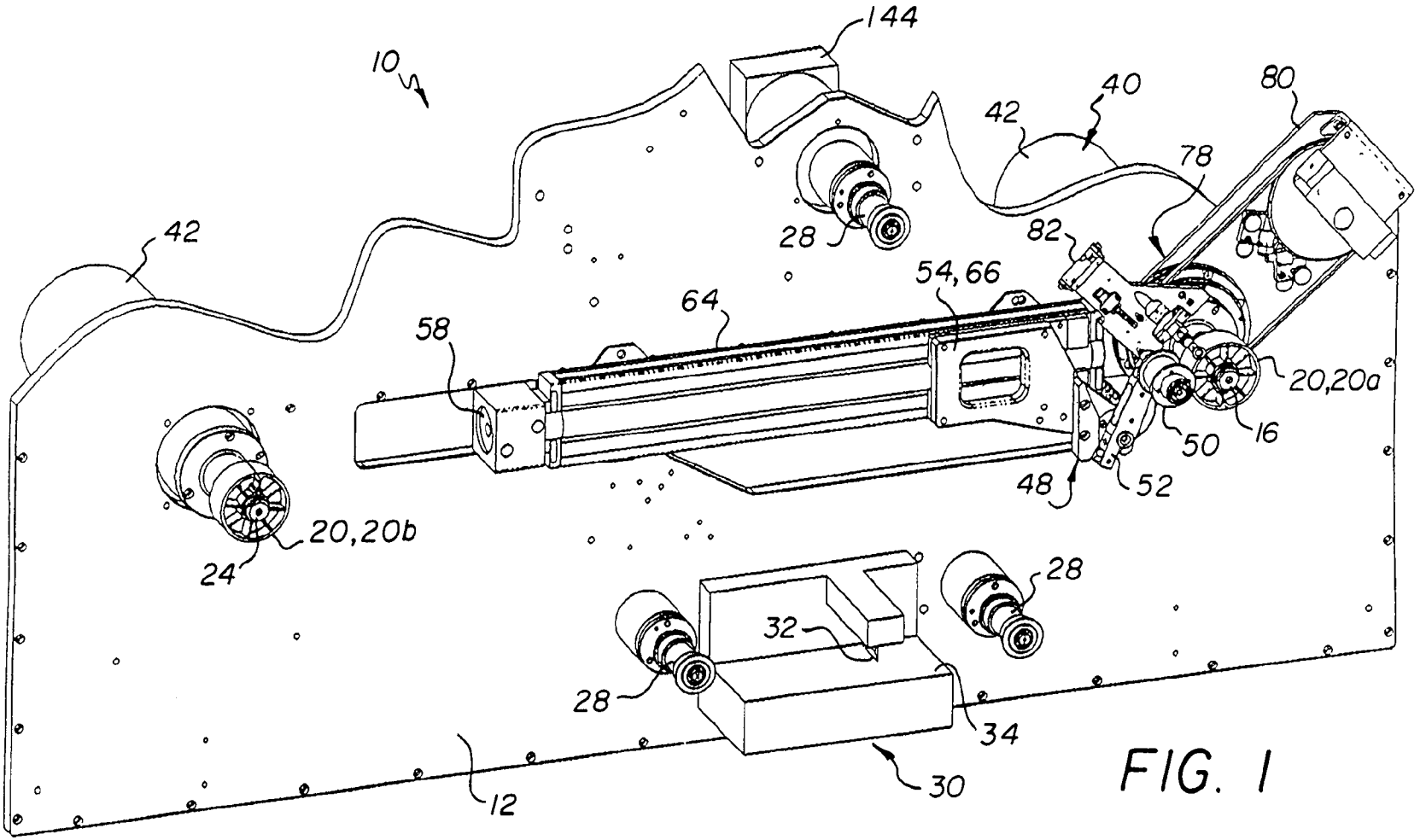
FIG. 1 is a front perspective view of an embodiment of the winding apparatus. Components are in position for cinching, but the web is not shown. The carriage and builder roller are in the forward position. The carrier is in the rotated position. The guide assembly is in the first orientation.
Figure 2:
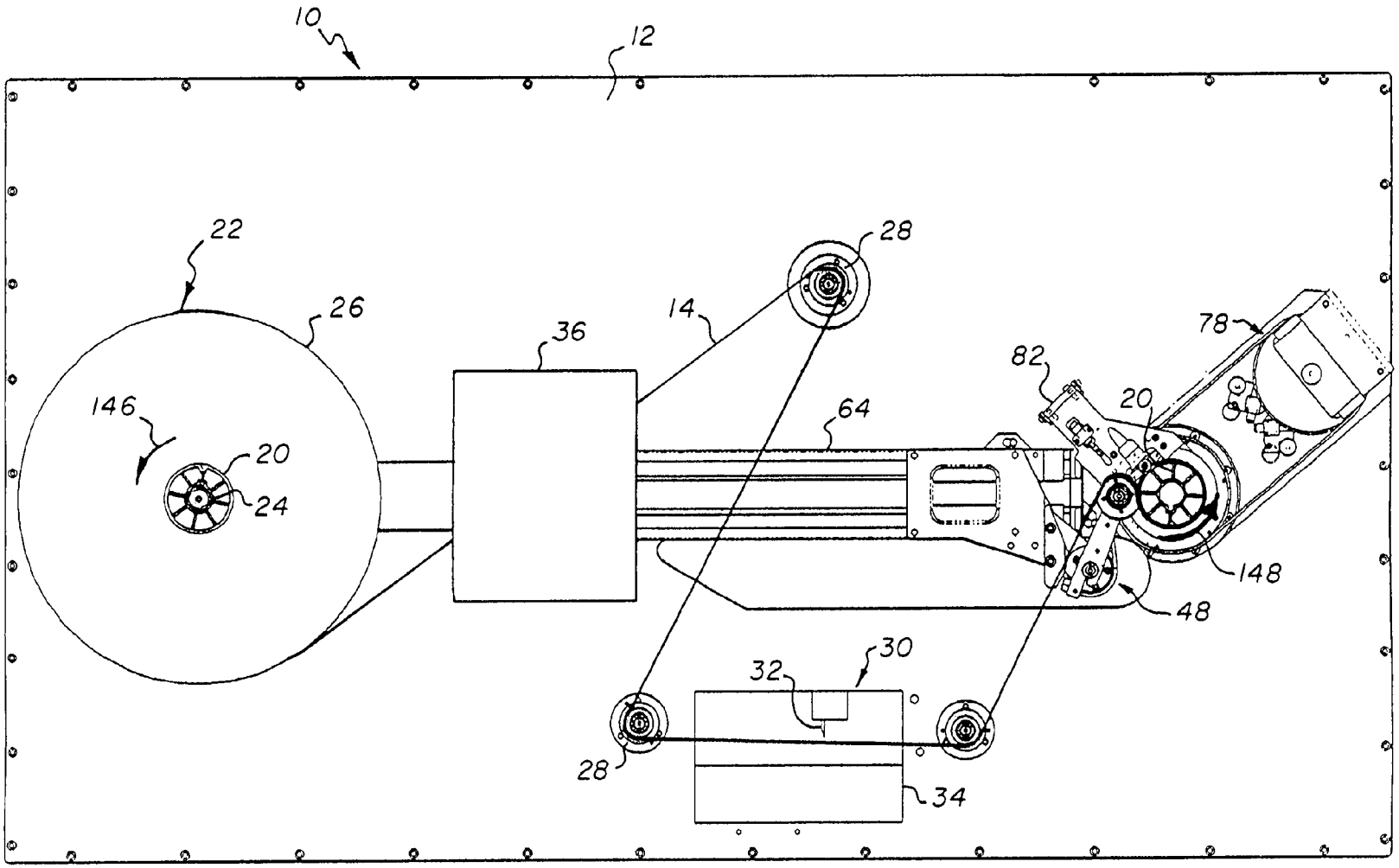
FIG. 2 is a front view of a modification of the apparatus of FIG. 1. The modification is the additional of a functional unit between the unwind web roll and one of the secondary rollers. The apparatus is shown during cinching. Arrows indicate the directions of rotation of the spindles.
Figure 3:
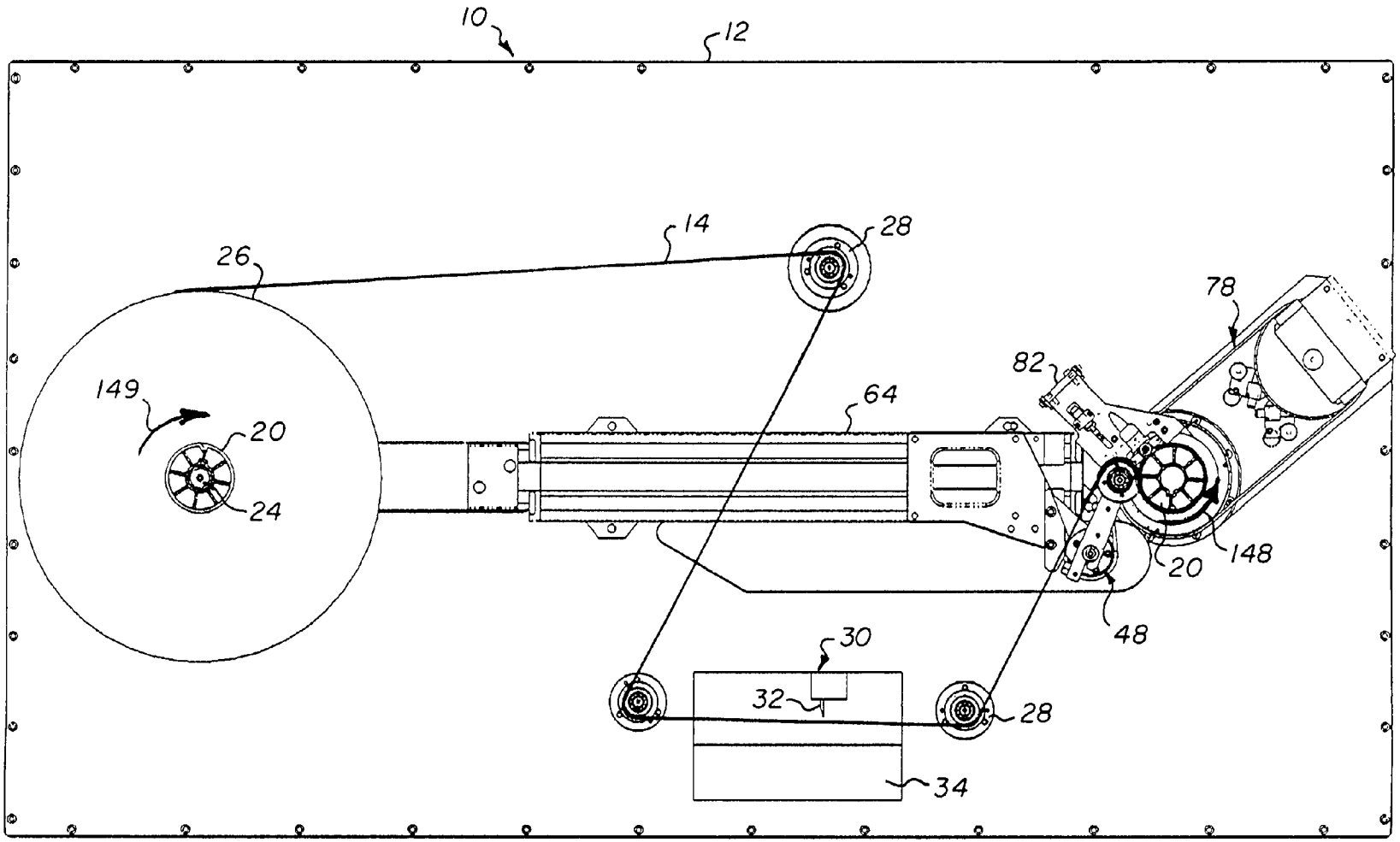
FIG. 3 is a front view of another embodiment of the apparatus. Arrows indicate directions of rotation of the spindles. The apparatus is shown during cinching.
Figure 4:
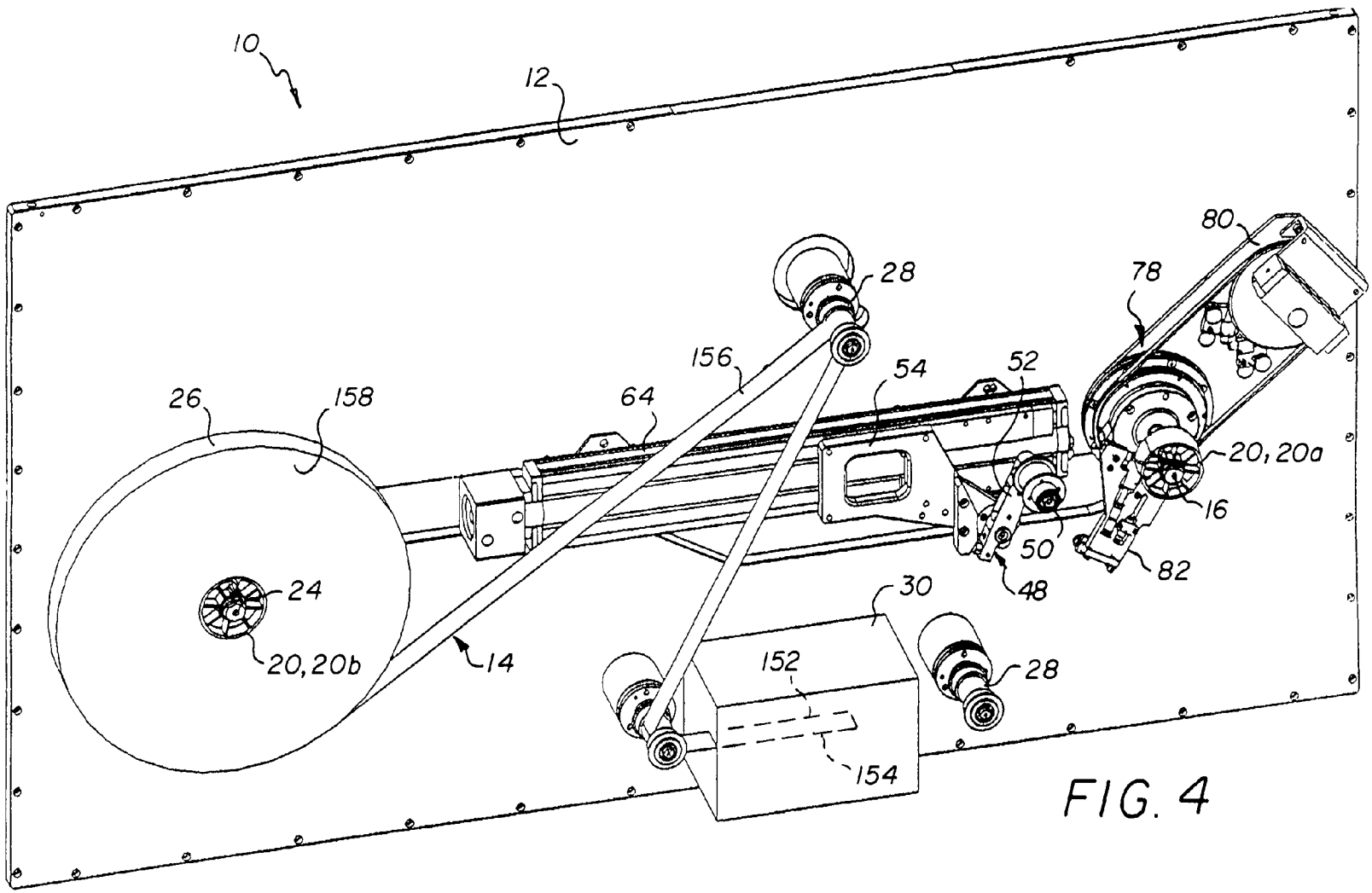
FIG. 4 is the same view as FIG. 1, but the web is shown and the apparatus is shown following cutting of the web. In this and some of the other drawings, the cover is illustrated as a rectangular box. The location of the free end of the web within the cutter is indicated by dashed lines. The carriage and builder roller are in the standby position. The builder roller is biased against the stop. The carrier and guide assembly are in the start position. The guide assembly is in the second orientation.
Figure 5:
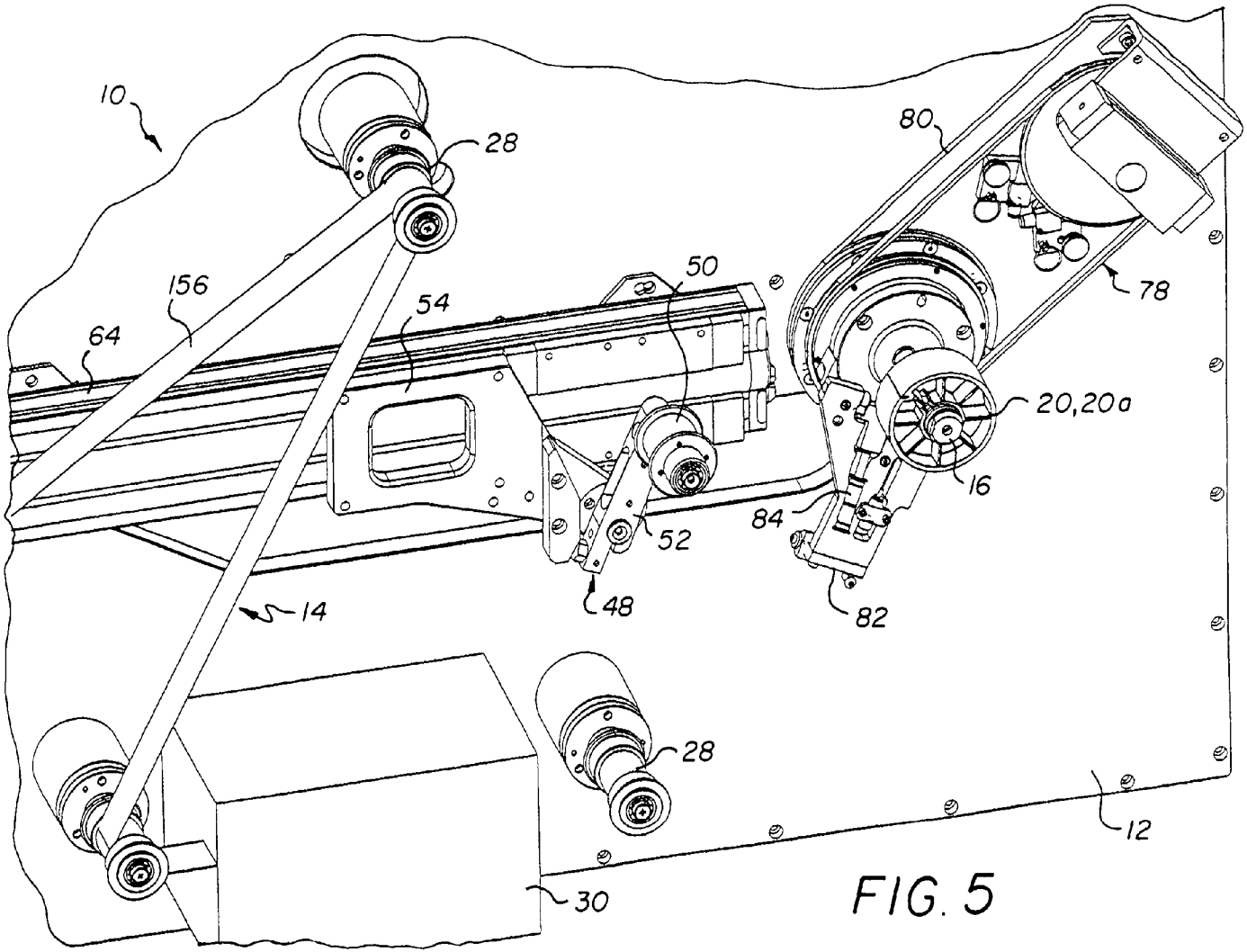
Figure 6:
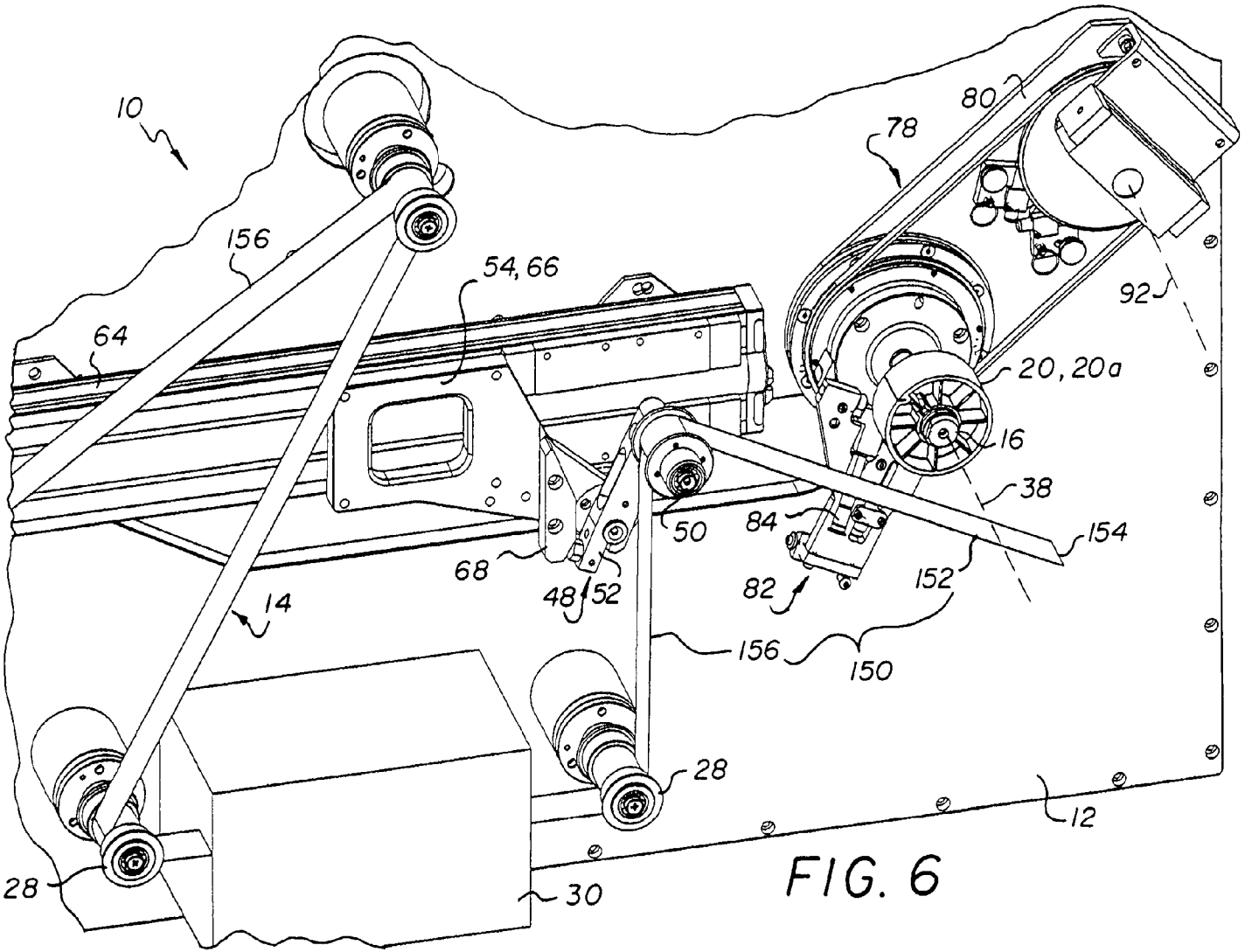
Figure 7:
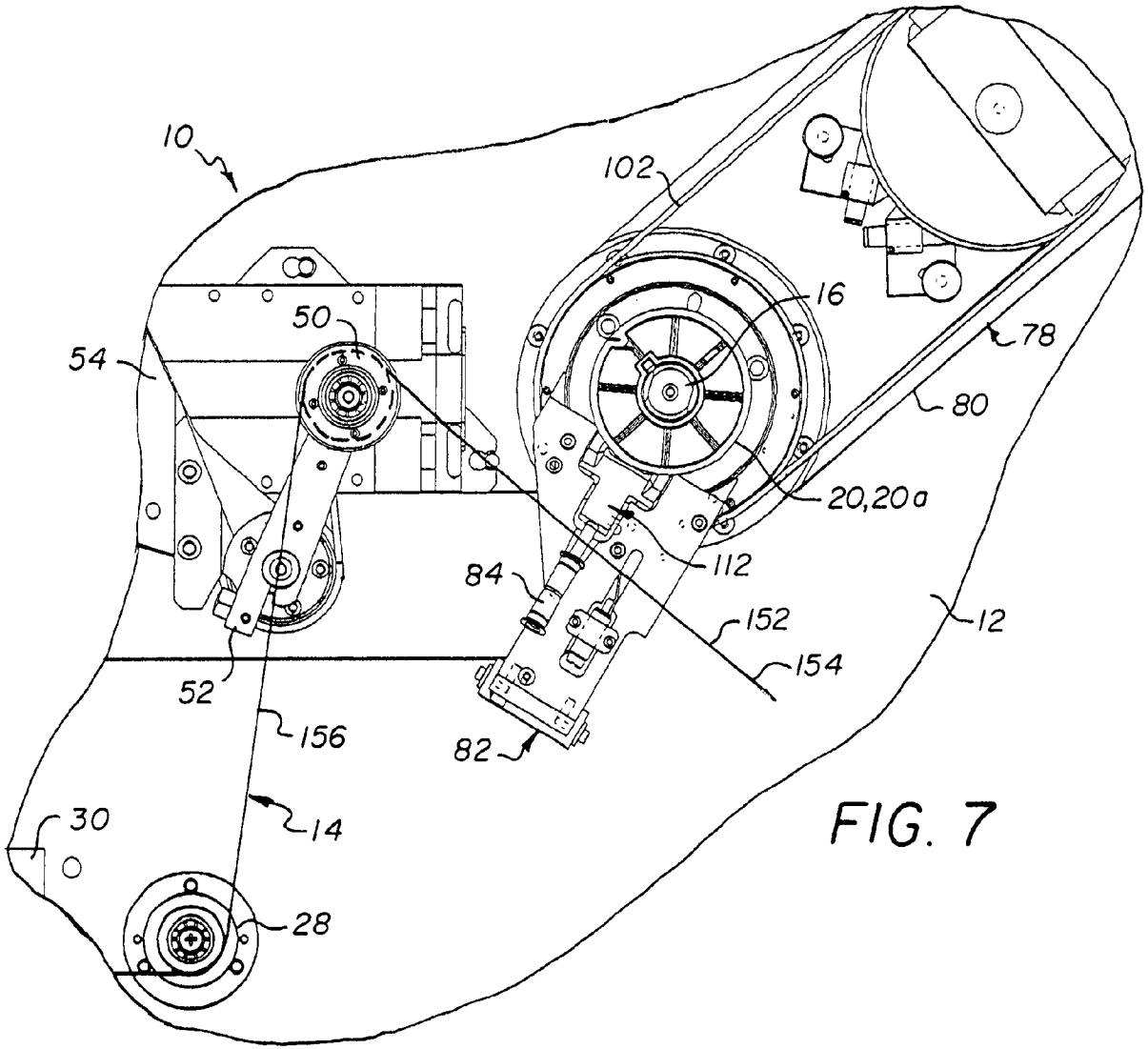
Figure 8:
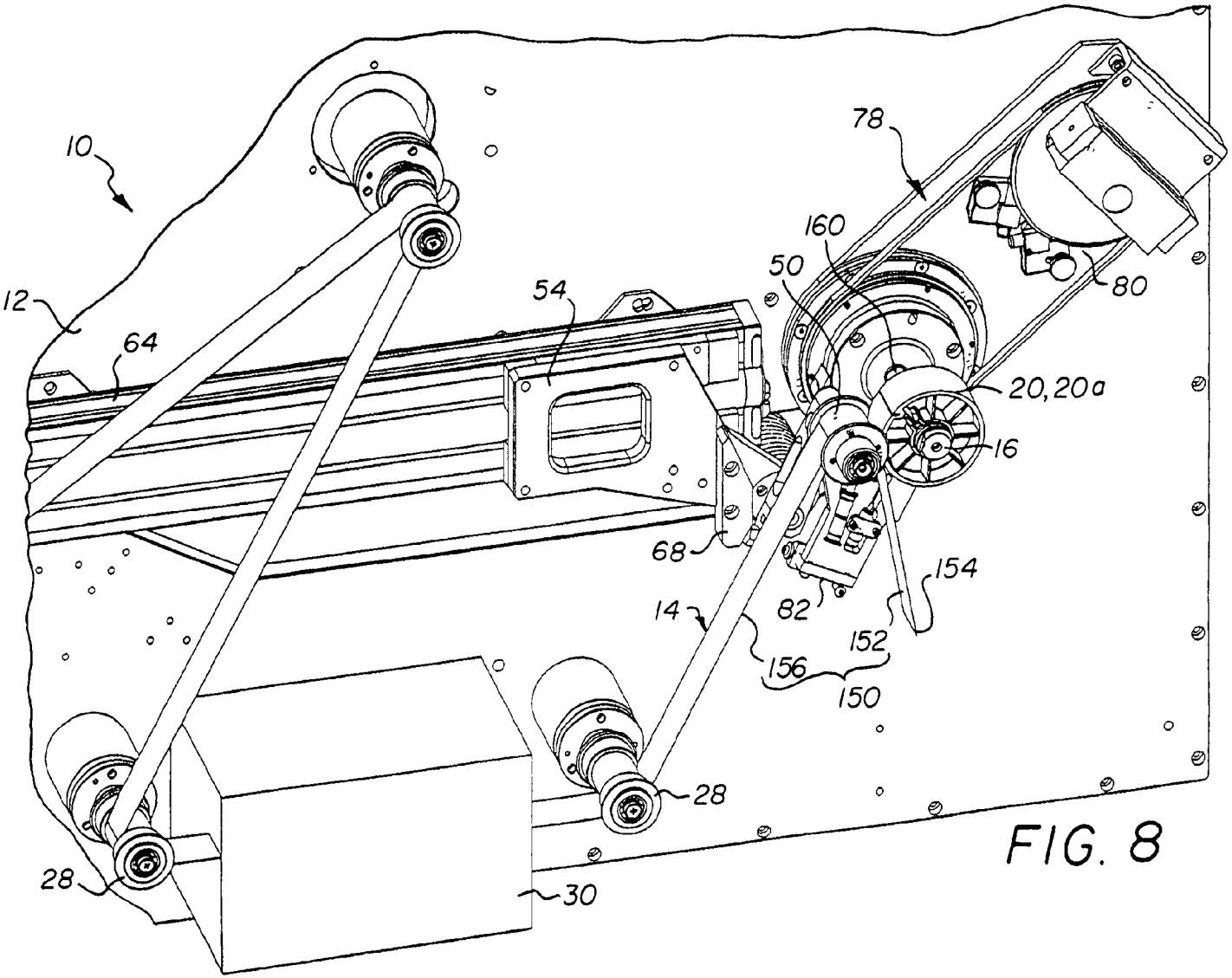
Figure 9:
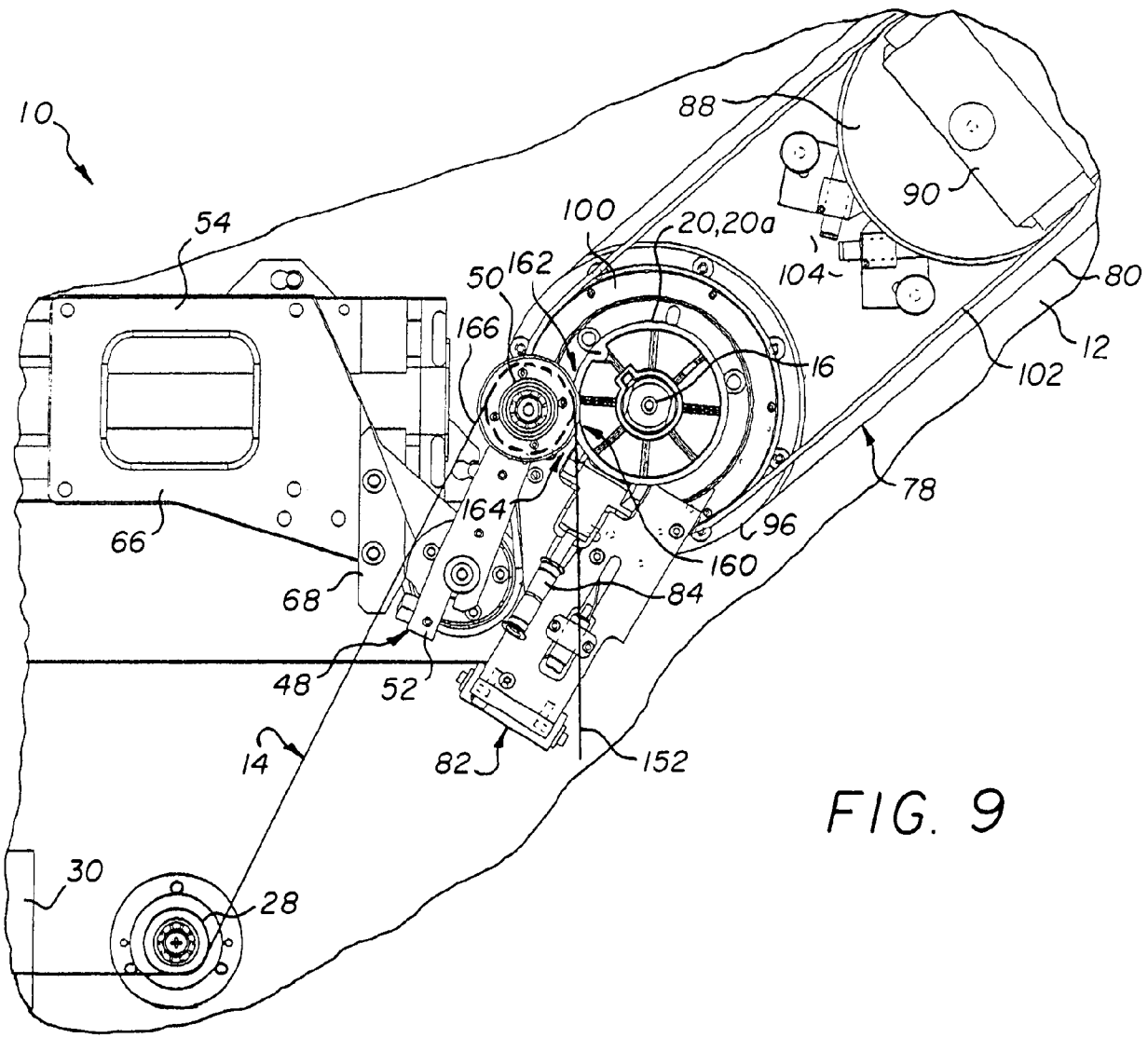
Figure 10:
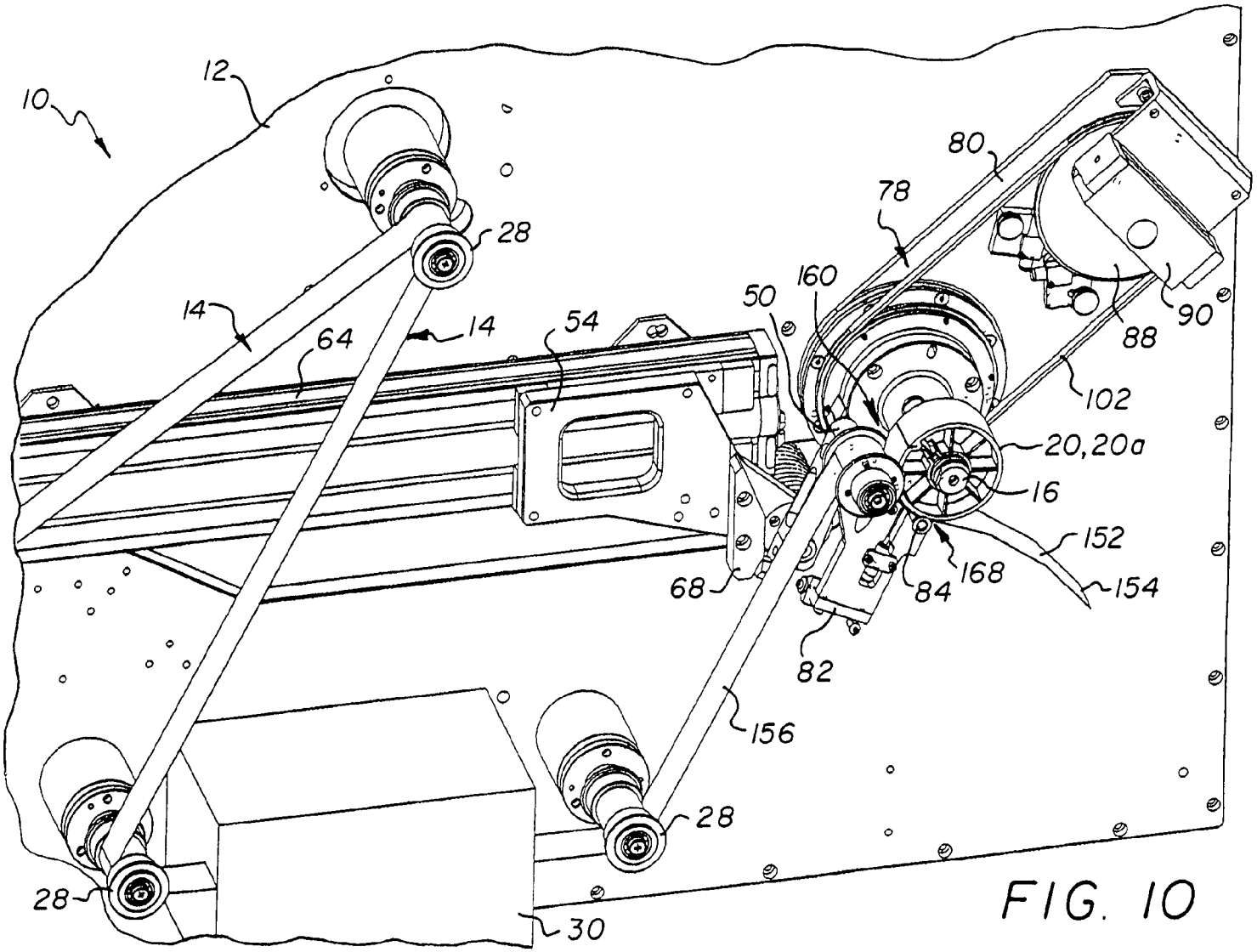
Figure 11:
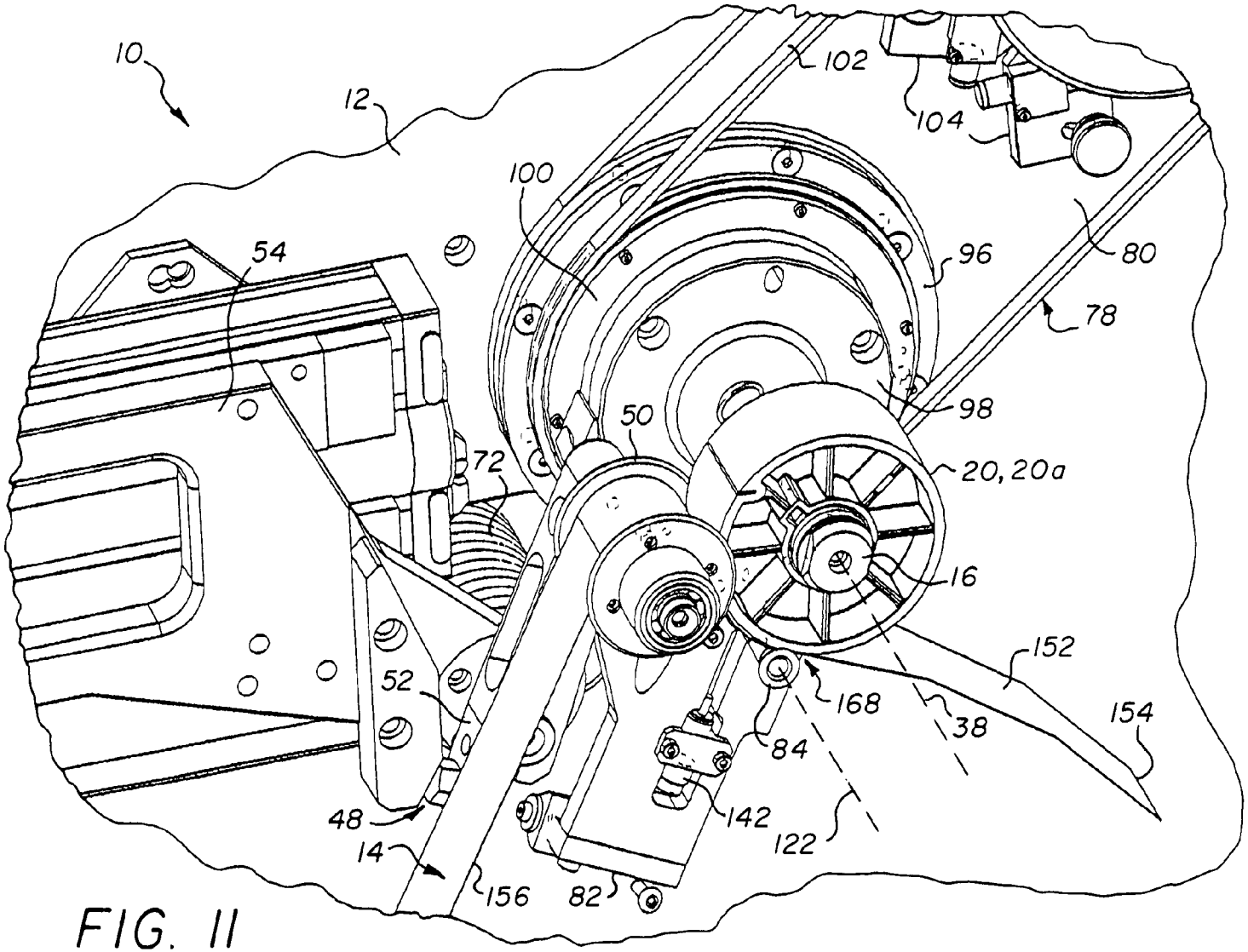
Figure 12:
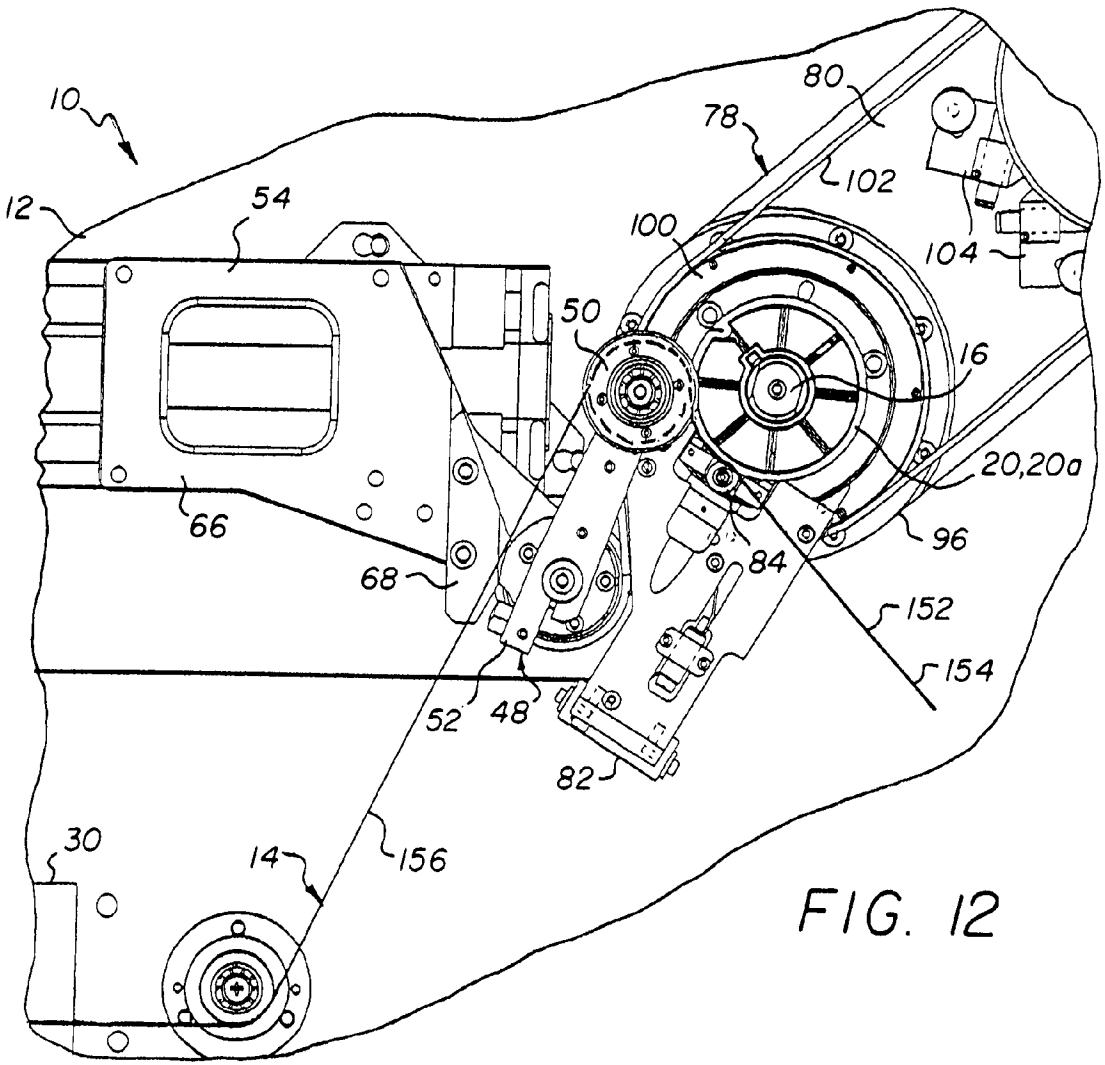

Referring initially to FIGS. 1–2, the winding apparatus 10 has a base 12 to which other components are attached. The base 12 is illustrated in the figures as a vertically aligned panel, but this is not critical. For example, the base 12 can be aligned horizontally or an assembly of smaller members (not illustrated) can be used instead of the panel. In the illustrated embodiments, features of the apparatus 10 that contact a web 14 are arranged on the front side of the base 12. This is a matter of convenience and can be changed to meet particular requirements. The invention is described in relation to and is particularly advantageous for the winding of photographic film. Webs of other materials can be wound in a like manner.

Figure 21:
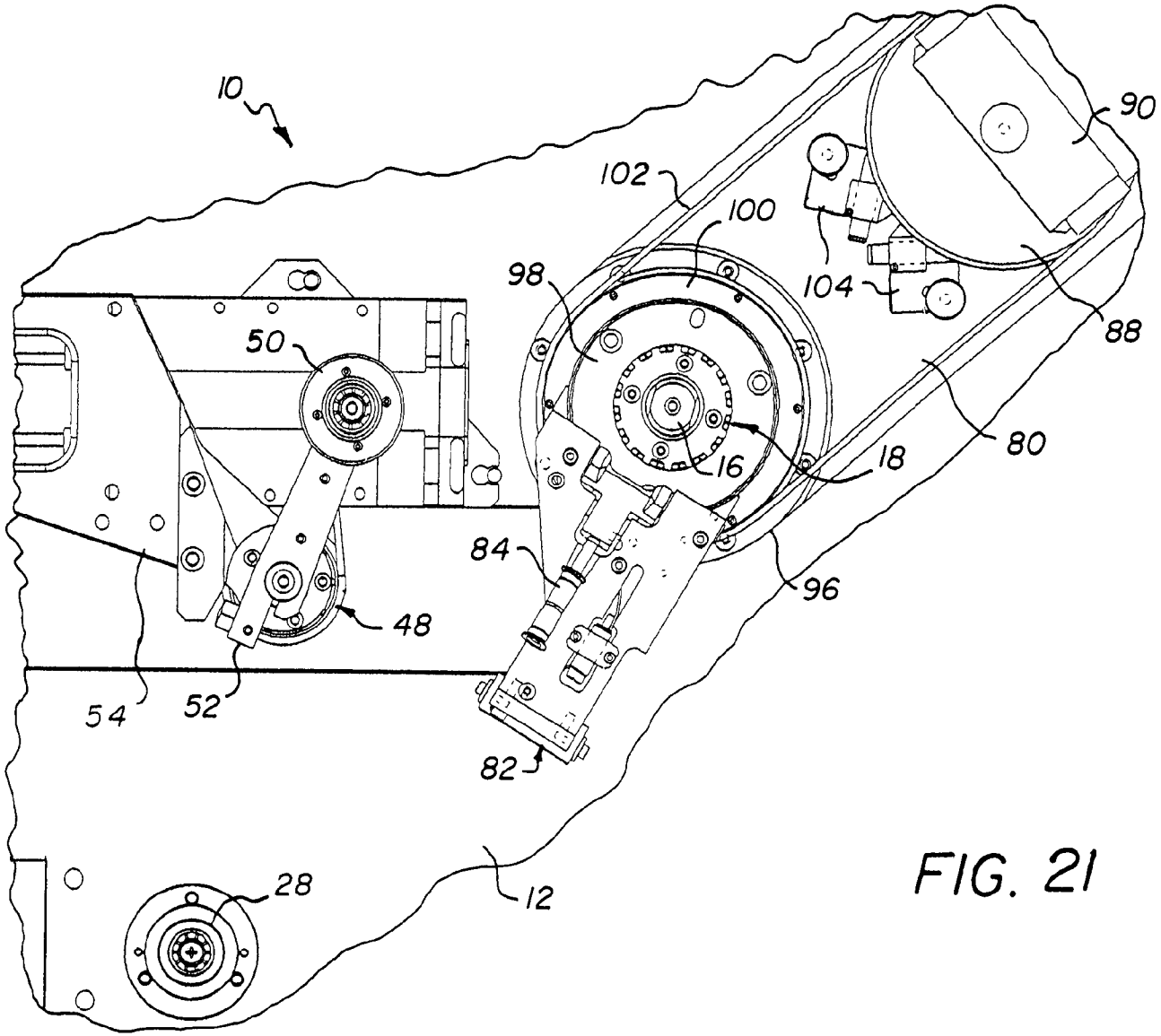
Figure 22:
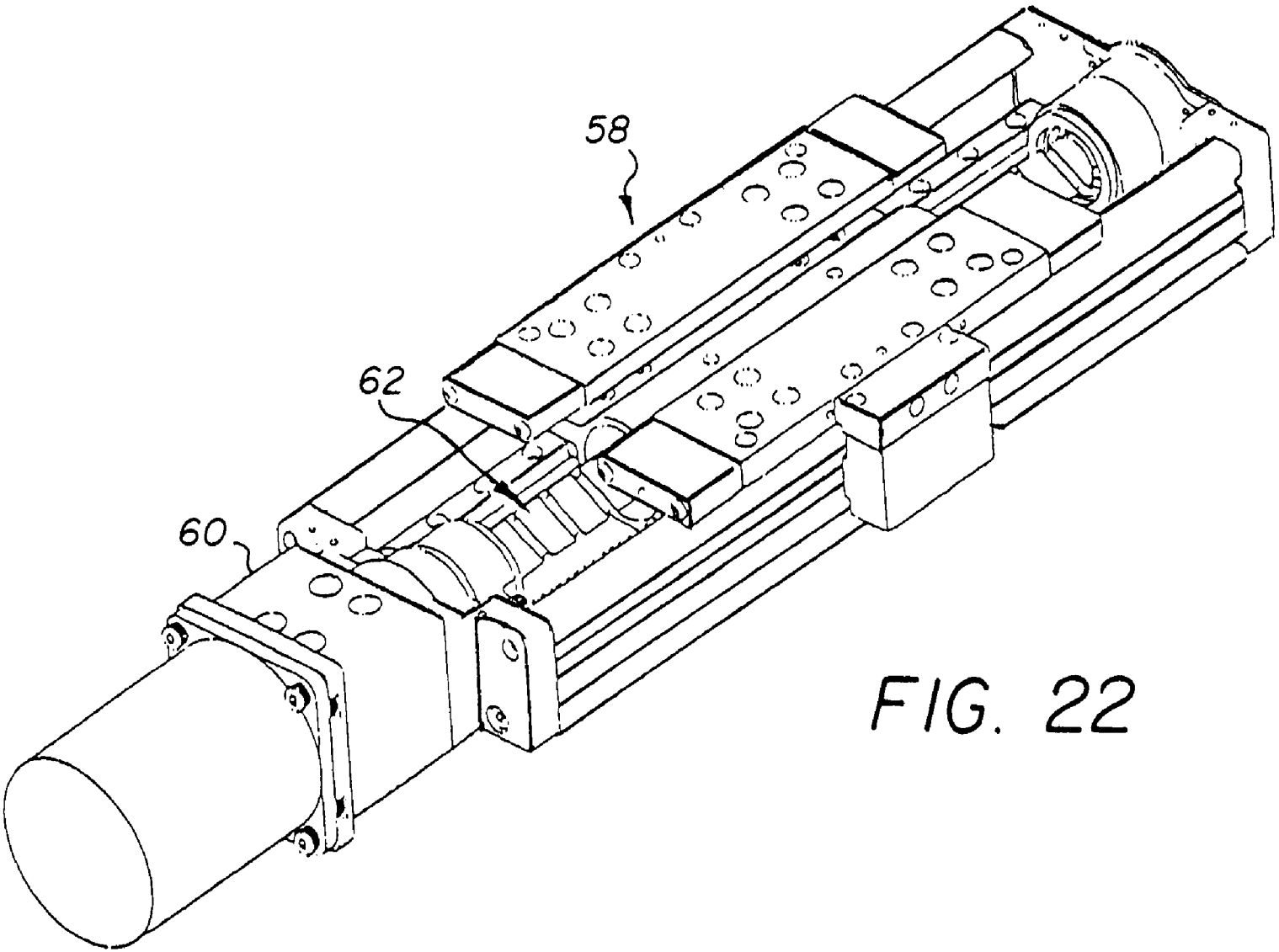
FIG. 22 is a perspective view of the builder drive of the apparatus of FIG. 1.
Figure 23:
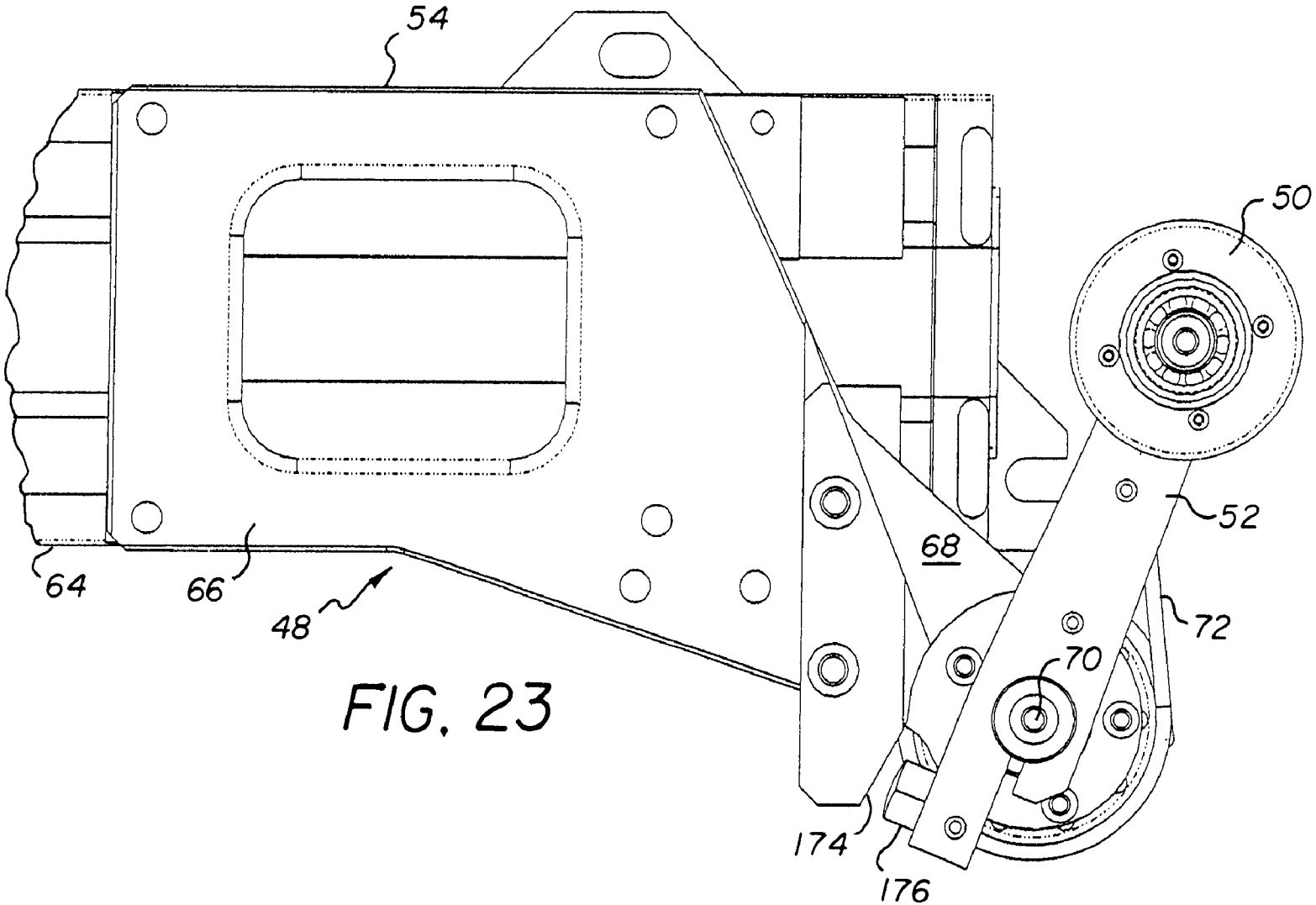
FIG. 23 is a front view of the forward end of the builder roller assembly of the apparatus of FIG. 1, showing the carriage and builder roller in the forward position.

A winding spindle 16 is mounted to the base 12. The winding spindle 16 defines a core space (indicated by arrow 18 in FIG. 21) that receives a core 20, when a core 20 is mounted on the winding spindle 16. The spindle 16 is configured to hold and turn the core 20 without slippage. Features for this purpose, such as square spindles 16,24 and matching core openings, are well known to those of skill in the art. In the illustrated embodiment, the spindle 16 has a protrusion that extends radially outward and is complementary to a pocket on the winding core. The cores 20 shown in the figures have a slot that can receive the free end of the web. This slot is present in conventional cores, but is not used in this invention.

A web supply 22 is mounted to the base 12 in spaced relation to the winding spindle 16. The configuration of the web supply 22 is not critical. In the winding apparatus 10 shown in FIG. 1, the web supply 22 has an unwinding spindle 24 and a web roll 26 that is wound around an unwind core 20 that is mounted on the unwinding spindle 24. Other configurations of web, such as a bin of bifolded web, can be used instead, depending upon web materials and other factors.

Additional components can also be provided as a part of the web supply 22. For example, components such as idler rollers, tensioners, and cutters, can be provided. Referring to FIGS. 1–2, a series of secondary rollers 28 are located between the spindles 16,24. One is above an imaginary line (not shown) connecting the spindles 16,24. Two are below that line. (The terms "above", "below", "under", and other directional terms used herein, are intended to aid in understanding of the drawings, but are otherwise arbitrary and are not intended to refer to absolute directions.)

A cutter 30 is located between two of the secondary rollers 28. The cutter 30 can be any of the mechanisms known to those of skill in the art for cutting webs. The web 14 extends through the cutter 30, as shown in FIG. 2, between a knife 32 and a platen 34. The knife 32 is pushed against the platen 34 to cut the web 14. The apparatus 10 is not limited to a web supply 22 having this particular arrangement. For example, more or less secondary rollers 28 can be provided, one or more secondary rollers 28 can be replaced by a fixed (immobile) guide (not shown) and one or more belts (powered or unpowered) can be used instead of or in addition to one or more of the secondary rollers 28.

The apparatus 10 can be limited to the function of rewinding film; however, other functions can also be provided. Such functions are illustrated diagrammatically in FIG. 2 by a function unit 36 in the shape of a box. Examples of function units include components for: digital scanning, optical projection, chemical processing, coating, laminating, and printing.

In the following, the cores 20 positioned on the winding spindle 16 and the unwinding spindle 24 are both the same; however, for convenience in the following discussion, the core 20 on the winding spindle 16 is sometimes referred to as the "winding core 20*a*" and the core 20 on the unwinding spindle 24 is sometimes referred to as the "unwind core 20*b*".

The winding spindle 16 rotates about a winding axis 38. This rotation is powered by a web drive 40. Additional components such as the unwinding spindle 24 can also be driven by the web drive 40. The web drive includes one or more motors and can optionally include a gear train or trains, belt or belts, or other transmission (not shown). In the illustrated embodiment, the winding spindle 16 and unwinding spindle 24 are each directly driven by a separate electric motor 42 and the secondary rollers 28 are all idlers.

Figure 37:
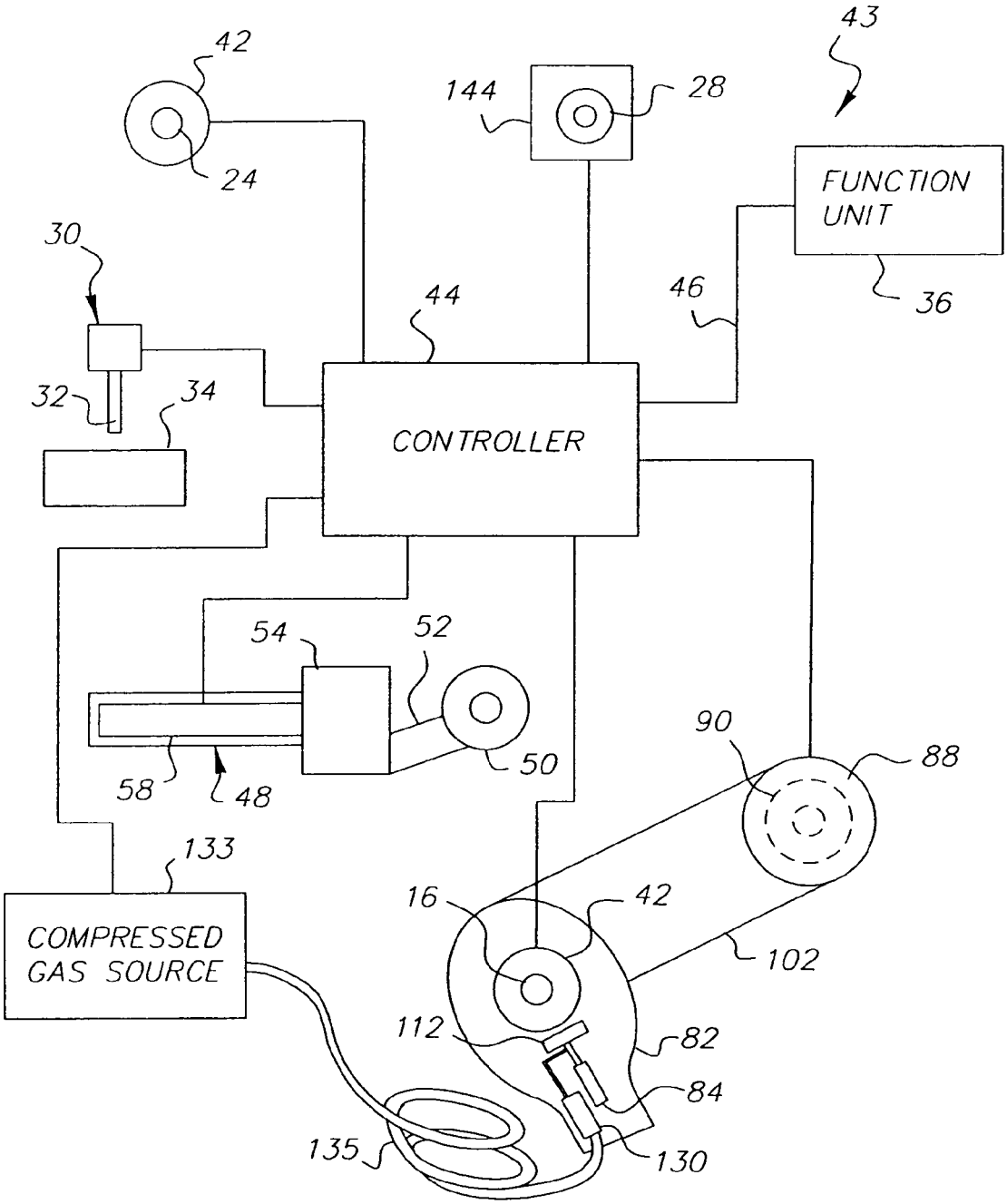
FIG. 37 is a schematic diagram of the control system of the apparatus of FIG. 1.
Figure 38:
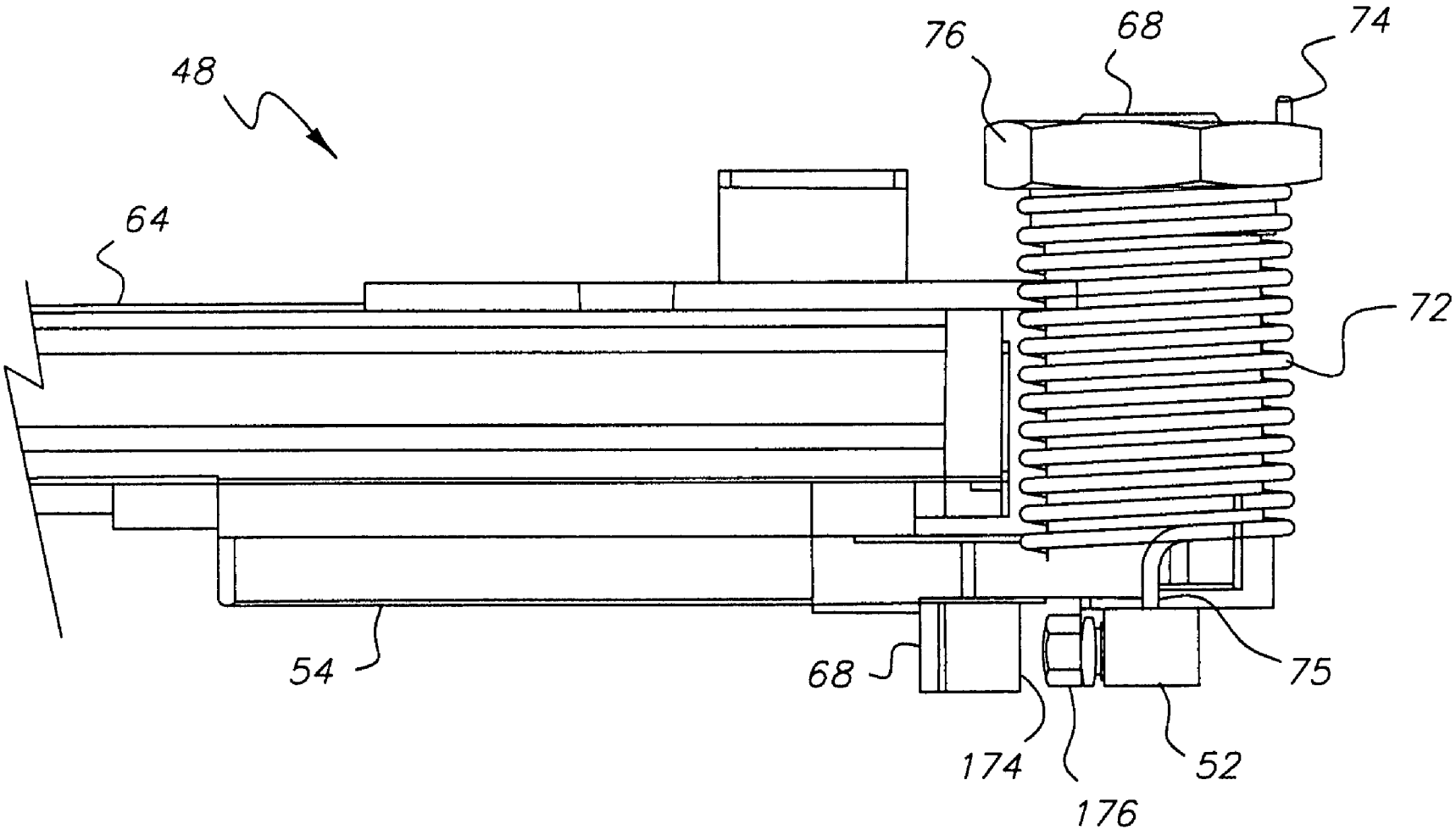
FIG. 38 is a partial top view of the builder roller assembly of FIG. 1.

Referring now to FIG. 37, a control system 43 of the apparatus 10 includes a microprocessor or other controller 44 that is connected to the motors 42 and other controlled components by signal lines 46. Features and operation of suitable controllers for this purpose are well known to those of skill in the art. Operations can also be sequenced manually using switches.

Figure 24:
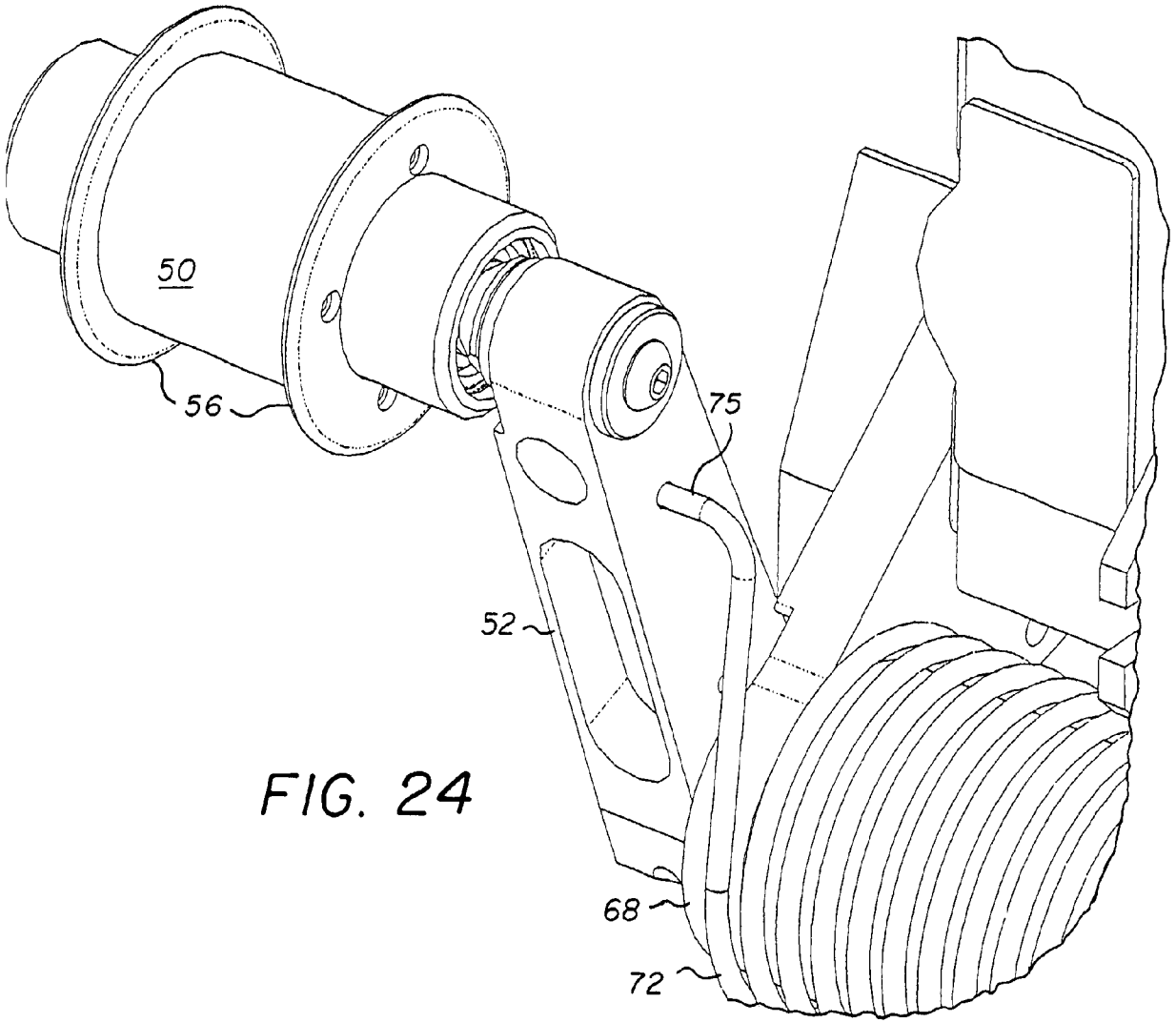
FIG. 24 is a rear, perspective view of the forward end of the builder roller assembly of FIG. 23.
Figure 25:
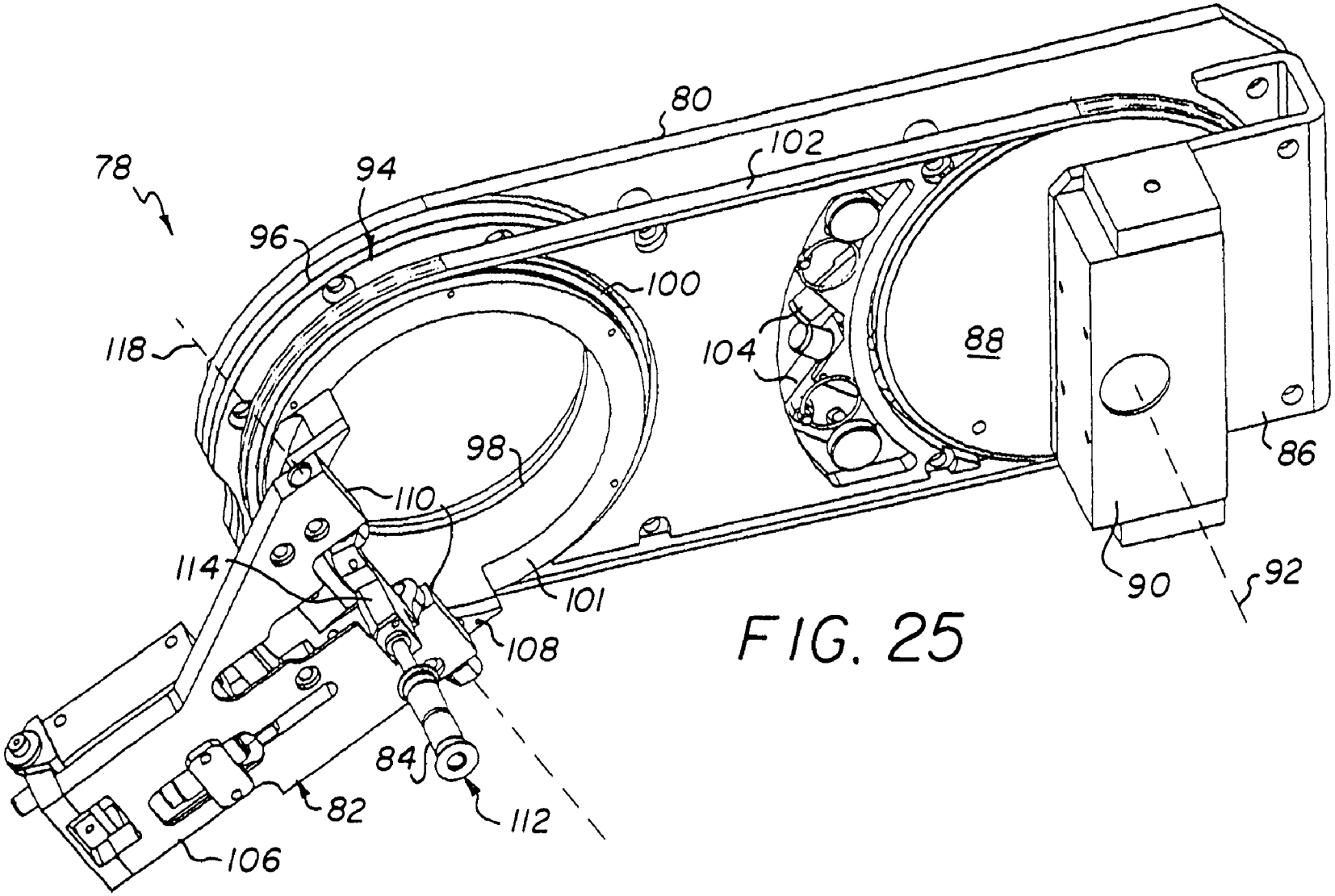
FIG. 25 is a perspective view of the cincher assembly of the apparatus of FIG. 1. The guide assembly as shown in the first orientation.

Between the unwinding spindle 24 and winding spindle 16 is a builder roller assembly 48. The builder roller assembly 48 includes a builder roller 50, which is supported on an arm 52 that is joined to a carriage 54. The builder roller 50 can be an idler, that is, unpowered; or can be driven. It is currently preferred, for simplicity, that the builder roller 50 not be driven. In the embodiments disclosed herein, the builder roller 50 has a pair of opposed builder roller flanges 56. (See FIG. 24.)

Referring to FIGS. 1, 22–24, and 38, the carriage 54 is movable toward and away from the winding spindle 16 by a builder drive 58. In illustrated embodiments, the builder drive 58 is a linear positioner having a servomotor 60 that drives a lead screw 62. The carriage 54 is translated by the lead screw 62. The builder roller assembly 48 has a track 64 that is aligned with the winding spindle 16. The carriage 54 has a main member 66 that rides rectilinearly on the track 64 when the lead screw 62 is turned. Other types of builder drives can be used, but a linear positioner is currently preferred.

In the embodiment shown, the arm 52 is pivotably joined to the carriage 54 and the carriage 54 has a support member 68 that is fixed to the main member 66. (The term "fixed" and like terms are used herein in the sense of joined in immobile relation to another part.) The support member 68 has a shaft 70 that is freely pivotable relative to the support member 68. The arm 52 is fixed to and pivots with the shaft 70.

The arm 52 is biased toward the winding spindle 16 by a biaser 72. Various types of biasers, such as air springs and torsion rods, can be used. In the illustrated embodiments, the biaser 72 is a coil spring that is coiled around the support member 68. A first end 74 of the spring 72 is held by an adjustment nut 76 (shown in FIG. 38) that is screwed on the end of the support member 68. A second end 75 of the spring 72 is held by the arm 52. The adjustment nut 76 can be rotated to adjust the spring force.

Referring now to FIGS. 1–21 and 25–30, a cincher assembly 78 adjoins the winding spindle 16. The cincher assembly 78 includes a mount 80 that is fixed to the base 12, a carrier 82 that is joined to the mount 80 and a cinch roller 84 that is joined to the carrier 82. The cinch roller 84 is movable, with the carrier 82, in an incomplete orbit about the winding core 20*a* and winding spindle 16.

In the illustrated embodiment, a sprocket support 86 is joined to the mount 80 at an outer end. A sprocket 88 is held between the sprocket support 86 and mount 80. The sprocket 88 is rotatable by a sprocket drive 90 about a sprocket axis 92 that is parallel to the winding axis 38 defined by the winding spindle 16. (See FIG. 6.)

A ring bearing 94 has first and second rings 96,98 that are freely movable relative to each other. The first ring 96 is fixed to the inner end of the mount 80. The first ring 96 is aligned with the sprocket 88. The second ring 98 is fixed to a ring gear 100 and a collar 101. The ring gear 100 and ring bearing 94 are coaxial with the winding axis 38. An endless belt 102 extends between the sprocket 88 and the ring gear 100. Shock absorbers 104 optionally provided on the mount 80 or sprocket support 86 damp vibration of the sprocket 88 and belt 102, during stopping.

The carrier 82 is movable with the collar 101. The carrier 82 has a holder plate 106 that is a fixed to extensions 108 of the collar 101. The extensions 108 axially space the holder plate 106 outward from the mount 80. The holder plate 106 is roughly Y-shaped and has a pair of ears 110 that are joined to the extensions 108 of the collar 101. A guide assembly 112 is mounted to the holder plate 106. The guide assembly 112 is rotatable about the winding axis 38 along with the carrier 82, collar 101, ring gear 100, and second ring 98.

The guide assembly 112 has a yoke 114 having a pair of opposed fingers 116. (See FIG. 28.) Each of the fingers 116 is pivotably joined to a respective ear 110 of the holder plate 106. The guide assembly 112 is pivotable relative to the holder plate 106 about a pivot axis 118. (See FIG. 25.)

An axle 120 is mounted to and extends outward from the yoke 114. The axle 120 defines a guide axis 122. The cinch roller 84 is mounted to the outer end 124 of the axle 120. The cinch roller 84 has a pair of opposed cinch roller flanges 126.

It is preferred that the cinch roller is gimbaled to the axle 120. It is further preferred that the cinch roller 84 is gimbaled to the axle 120 at the longitudinal center of the cinch roller 84. In the illustrated embodiments, the cinch roller 84 is gimbaled to the axle 120 midway between the cinch roller flanges 126, by a gimbal bearing 128. (See FIG. 29.) The gimbal bearing 128 allows the cinch roller 84 to freely pivot back and forth, into and out of alignment with the guide axis 122. In the illustrated embodiment, the gimbaling is over a total range of about six degrees.

An actuator 130 is operatively connected to the yoke 114 of the guide assembly 112, directly or by a linkage or other mechanical coupling. The actuator 130 can be a servomotor or pneumatic drive element or the like. The actuator 130 moves the guide assembly 112 between a first orientation and a second orientation. In the first orientation, the axle 120 of the guide assembly 112 is disposed parallel to the winding axis 38. (See, for example, FIG. 11.) In the second orientation, the axle 120 of the guide assembly 112 is transverse to the winding axis 38. (See, for example, FIG. 16.) In the illustrated embodiment, the guide assembly 112 is disposed within the opening between the ears 110 of the holder plate 106 and the guide assembly 112 is at least roughly radial to the winding axis 38, in the second orientation and the cinch roller 84 and axle 120 extend outward from the holder plate 106, in the first orientation.

Figure 26:
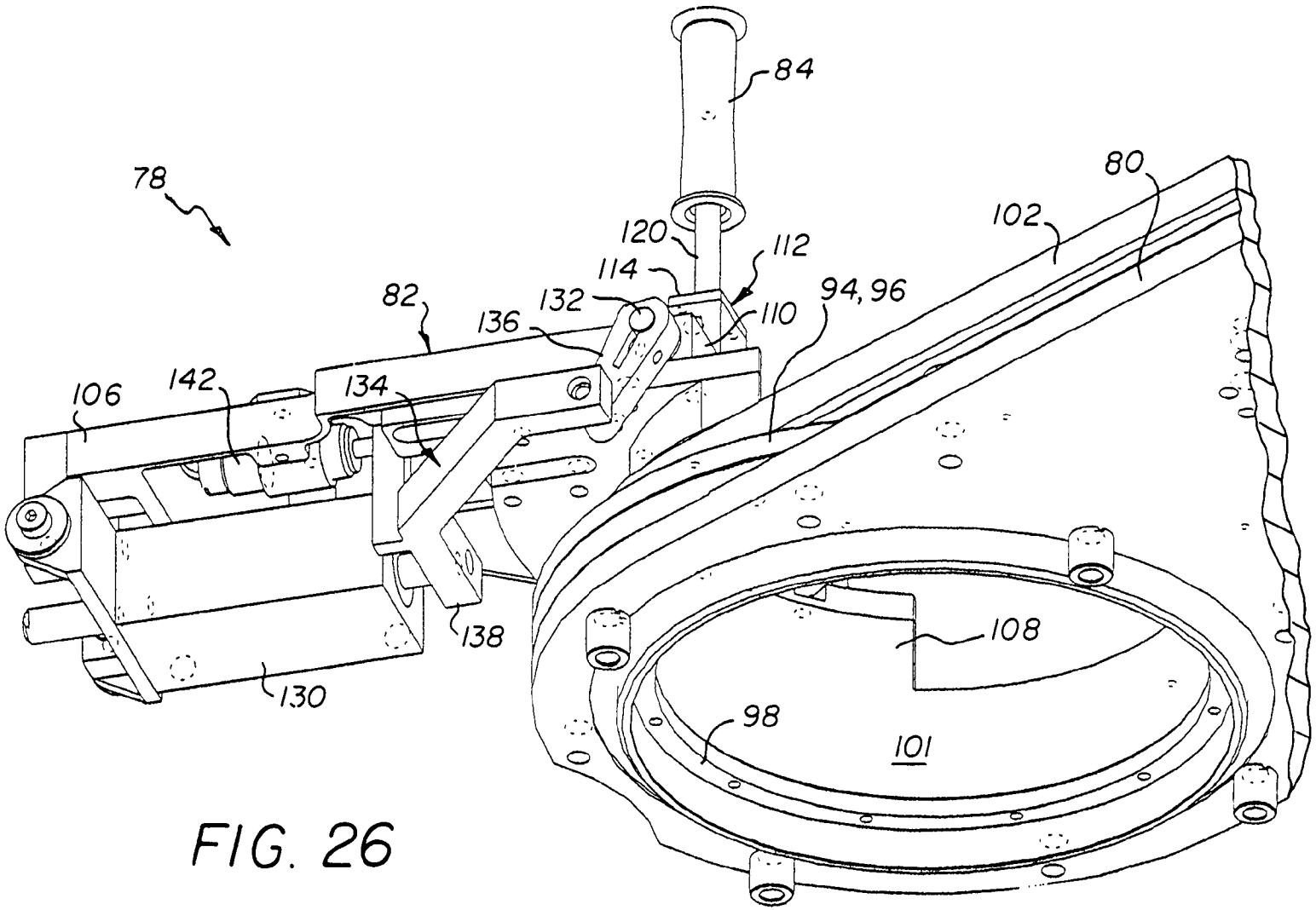
FIG. 26 is a partial, rotated, rear perspective view of the cincher assembly of FIG. 25.
Figure 27:
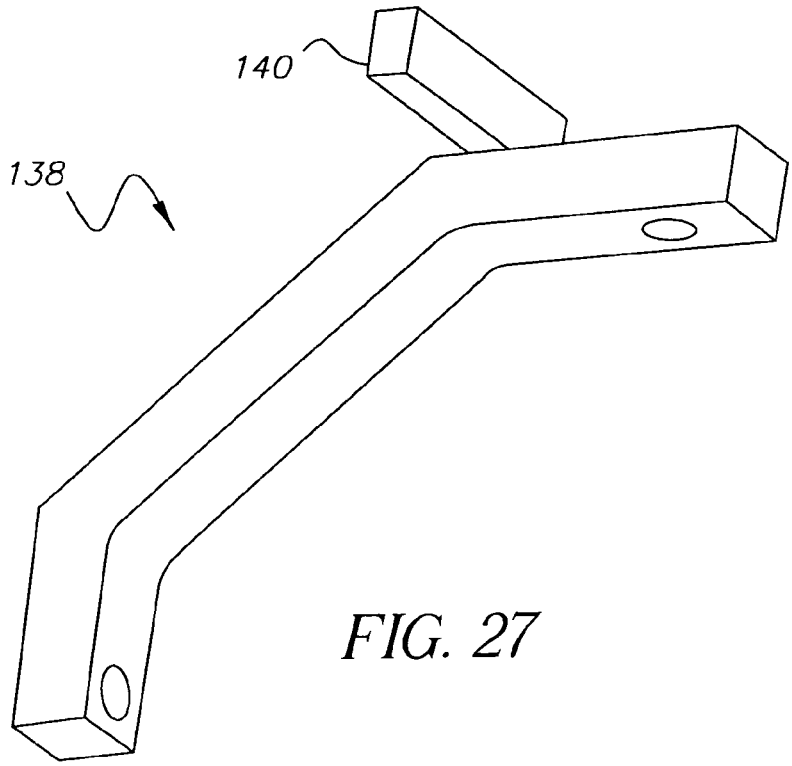
FIG. 27 is a perspective view of the second link of the linkage of the cincher assembly of FIG. 26.
Figure 28:
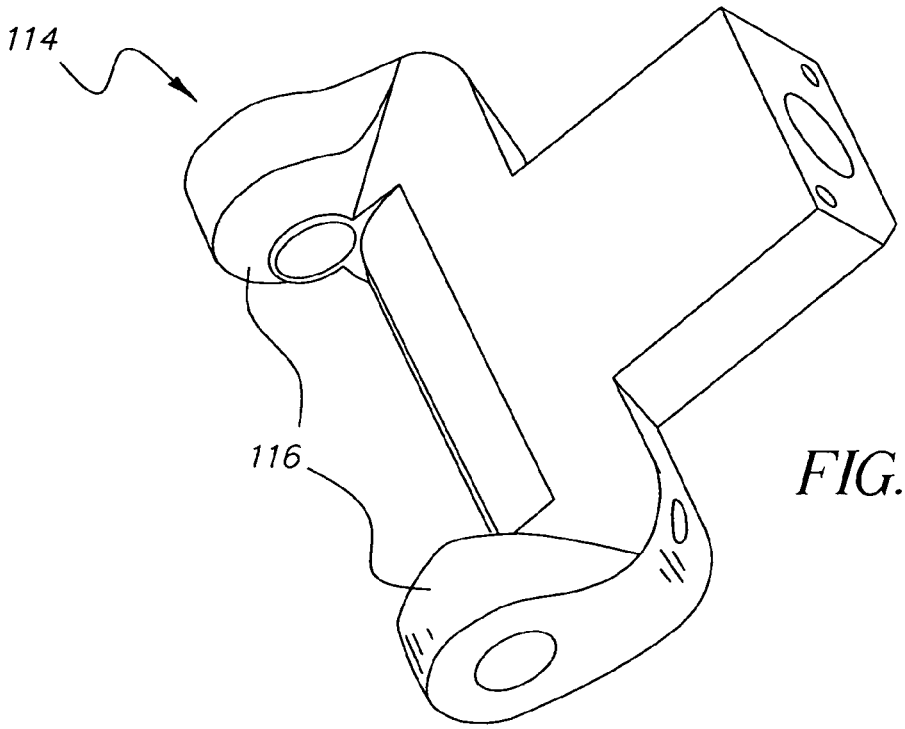
FIG. 28 is a perspective view of the yoke of the cincher assembly of FIG. 25.
Figure 29:
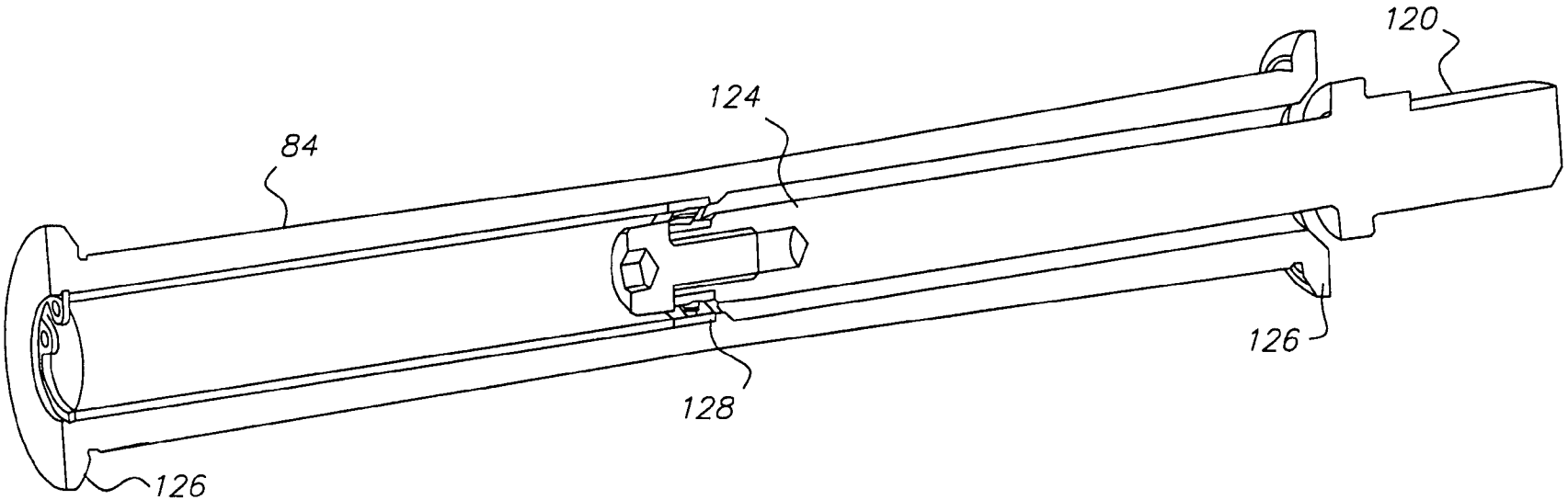
FIG. 29 is a cutaway view of the cinch roller and axle of the cincher assembly of FIG. 25.
Figure 30:
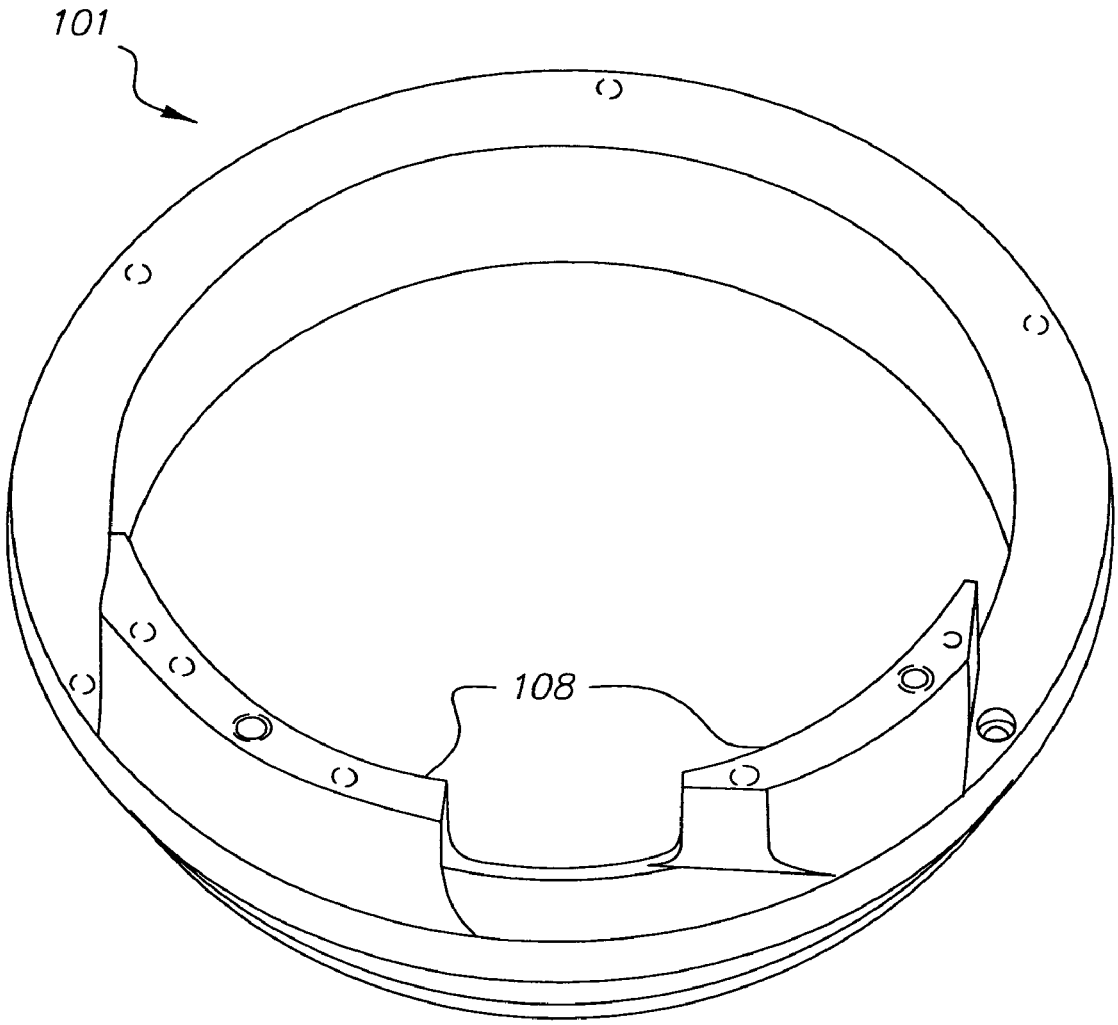
FIG. 30 is a perspective view of the collar of the cincher assembly of FIG. 25.

In the illustrated embodiment, the yoke 114 has a post 132 that extends outward through one of the ears 110 of the holder plate 106. A linkage 134 couples the post 132 to the actuator 130, in this case to the piston of an air cylinder that is connected to a compressed air source 133 (shown in FIG. 37) by a line 135 (illustrated in FIG. 37 as a flexible hose). The linkage 134 has a first link 136 that is rigidly attached to the post 132. A second link 138 is pivotably joined to the first link 136 and extends outward to the actuator 130. The second link 138 optionally has a leg 140 that extends out to a shock absorber 142 to damp movement of the yoke 114 during use. The air cylinder or other actuator 130 can be pivotably mounted, as shown in FIG. 26, to provide a slight free play in the linkage 134 and, thus, reduce a risk of binding.

Operation of the apparatus 10 can be controlled manually, or by mechanic logic, that is, mechanical connections that coordinate operation of the various features. The apparatus 10 can also be controlled by a microprocessor or other electronic controller 44, as illustrated in FIG. 37. Sensors can be provided as needed to detect web 14 movement, rotation of components, or other operational parameters. In the illustrated embodiments, an encoder 144 is shown attached to one of the secondary rollers 28. Communication lines operatively connect the controller 44 to controlled drives, sensors, and other features.

In some uses, it may be desirable to add additional components to the apparatus 10. An example of such a component is a web tensioner (not shown). Features and use of web tensioners, guides, and other such components are well known to those of skilled in the art.

Apparatus 10 can be changed in other ways to meet the requirements of a particular use. In the embodiment of the apparatus 10 above described, the web 14 is taken off the bottom of the unwind web roll 26 and the spindles 16,24 rotate in the directions indicated by arrows 146 and 148. The outer surface of the web 14 of the unwind web roll 26 becomes the outer surface of the web 14 of the wind web roll 26. (See FIG. 2.) In an alternative embodiment shown in FIG. 3, the direction of rotation of the unwinding spindle 24 is reversed, as indicated by arrow 149, and the web 14 is taken off the top rather than the bottom of the unwind web roll 26. In this case, the web 14 is turned over during the winding process.

Referring now to FIGS. 4–21, in the winding methods, a web roll 26 is placed on the unwinding spindle 24. The web roll 26 has a core 20*a* and a roll of web 14 wrapped around the core 20*a*. An empty core 20 (the winding core 20*a*) is placed on the winding spindle 16.

A starter segment 150 of the web 14 is next unwound. The starter segment 150 of the web 14 includes a leading portion 152 that has a free end 154 and a threading portion 156 that connects the leading portion 152 to the remainder 158 of the unwind web roll 26. (See FIG. 4.) During cinching, the leading portion 152 of the web 14 is wrapped around the winding core 20*a*. It is highly preferred that this leading portion 152 of the web 14 has a length that accurately and precisely matches a predetermined value within a predetermined tolerance. This can be easily achieved by unwinding a starter segment 150 from the unwind web roll 26 that is only as long as is needed for threading and for the leading portion 152. This can be done manually by measuring the starter segment 150, but is more easily done using a driven unwinding spindle 24, a controller, and an encoder or other sensor that measures the length of the web that is supplied.

In the illustrated embodiment, the web 14 is threaded from the unwind web roll 26, over two of the secondary rollers 28, and through the cutter 30. This initial threading of the web 14 can be performed manually or using automated equipment, in a manner known to those of skill in the art. The knife 32 of the cutter 30 cuts the web 14 to provide an initial datum. (See FIGS. 4–5.) The controller 44 then advances the web 14 by a predetermined length to provide a starter segment 150 having required threading and leading portions 156,152. (See FIGS. 6–7.)

In the illustrated embodiments, the length of the threading and leading portions 156,152 remains constant. This is not the case if the required web portions have variable lengths due to the action of a web tensioner or other component that can alter the path of the web 14 from the web roll 26. In this case, the required length for the starter segment 150 needs to be monitored manually or by use of sensors, and adjustments provided as needed.

After the starter segment 150 has been advanced, the starter segment 150 is threaded under the right lower secondary roller 28, and back up to the builder roller 50. The starter segment 150 is then draped over the top of the builder roller 50. (See FIGS. 6–7.) This continued threading and draping of the web 14 can be performed manually (as required in the illustrated embodiments) or automatically using a pick and place device or the like. Threading and draping can occur concurrent with the advancing of the starter segment 150 or following advancing, with the web 14 stopped.

After the draping of the starter segment 150 over the builder roller 50, the carriage 54 is translated toward the winding core 20*a* from a standby position to a forward position. In the standby position, the builder roller 50 is spaced away from the winding spindle 16. (See FIGS. 6–7.) In the forward position, a primary nip 160 is formed between the builder roller 50 and the winding core 20*a*. (See FIGS. 8–9.) The primary nip 160 has a long dimension that is parallel to the winding axis 38. In moving to the forward position, the builder roller 50 deflects the web 14 against the winding core 20*a*, thus the primary nip 160 is occupied by the web 14.

The primary nip 160 has an infeed side 162 and an outfeed side 164. (See FIG. 9.) In the figures, the infeed side 162 is above the outfeed side 164. The leading portion 152 of the web 14 extends from the outfeed side 164 of the primary nip 160 to the free end 154. The rest of the web 14, also referred to herein as the continuing portion 166, extends from the infeed side 162 of the primary nip 160 to the unwind web roll 26.

When the carriage 54 is translating from the standby position to the forward position, the guide assembly 112 is in the second orientation. After the builder roller assembly 48 reaches the forward position and the builder roller 50 and winding core 20*a* have formed the primary nip 160, the guide assembly 112 is pivoted relative to the holder plate 106 into the first orientation. During this pivoting, the cinch roller 84 comes into contact with the leading portion 152 of the web 14 and then pushes the leading portion 152 against the winding core 20*a*. The position of the leading portion 152 at this time may be as shown in FIGS. 8–12, or may be inclined or curled toward or away from the builder roller 50. This is not a problem unless the guide assembly 112 could catch against and misdirect the leading portion 152 during pivoting. This can be compensated for by manual movement of the leading portion 152 by the operator or by addition of one or more guides (not shown) to direct the leading portion 152 toward one of the positions shown in FIGS. 8–12.

When the guide assembly 112 is in the first orientation, the cinch roller 84 and the winding core 20*a* together define a secondary nip 168. (See FIGS. 10–12.) The secondary nip 168 has a long dimension that is parallel to and spaced from the primary nip 160. The secondary nip 168, like the primary nip 160, is occupied by the web 14.

If the apparatus 10 is to be used for winding photographic film, then it is preferred that the film be contacted in the primary and secondary nips 160,168 only at opposed lateral margins of the film. This prevents pressure marking in image areas of the film, since the film is not contacted between the lateral margins. In this case, each nip 160,168 can be considered to have two spaced apart segments separated by an enlarged gap in which the web 14 is not squeezed. In other embodiments, the nips are continuous from side to side and can continuously contact the web between lateral margins of the web.

When the secondary nip 168 is first formed, the cinch roller 84 is in a start position at the outfeed side 164 of the primary nip 160, in an approximately 8 o'clock position relative to the winding axis 38. (See FIGS. 10–12.) The guide assembly 112 is next moved in an incomplete orbit about the winding axis 38 and winding spindle 16, to a rotated position at the infeed side 162 of the primary nip 160, in an approximately 10 o'clock position. (See FIGS. 13–15.) The arc of the incomplete orbit is greater than 180 degrees. It is currently preferred that the guide assembly 112 be rotated through 270 degrees or more. The rotation of the guide assembly 112 is accompanied by rotation of the carrier 82, collar 101, ring gear 100, and second ring 98 through the same arc.

During rotation of the cinch roller 84 about the winding core 20*a*, the secondary nip 168 travels along the leading portion 152 of the web 14 and most of the way around the winding core 20*a*. This travel of the secondary nip 168 bends the leading portion 152 of the web 14 into a loop and presses the leading portion 152 against the winding core 20*a*.

In the illustrated embodiments, the leading portion 152 of the web 14 is smoothed onto the winding core 20*a*, with little or no deleterious contact, such as scuffing, stretching, or bunching. Several features of the illustrated embodiments provide this result.

In the illustrated embodiments, the primary nip 160 is formed before the formation of the secondary nip 168. This approach, in combination with the close positioning of the two nips 160,168 when the secondary nip 168 is initially formed, tends to minimize slack in the web 14 between the two nips 160,168. Slack is undesirable, because, during travel of the secondary nip 168, the cinch roller 84 would tend to pull the slack portion against the winding core 20*a* leading to possible damage.

In the illustrated embodiments, during the travel of the secondary nip 168, the linear velocity of the leading portion 152 of the web 14 relative to the winding core 20*a* is at or near zero at the secondary nip 168. This prevents differential movement of the leading portion 152 relative to the winding core 20*a*, which could lead to damage to the leading portion 152. The zero relative linear velocity of the winding core 20*a* and leading portion 152 is achieved by holding both web advance and winding core 20*a* rotation stopped, while the cinch roller 84 travels from the start position at the outfeed side 164 of the primary nip 160 to the rotated position at the infeed side 162 of the primary nip 160. Web advance can be stopped at the web supply 22, but it is preferred that web advance is stopped at or near the primary nip 160.

The web advance can be stopped by pinching the web 14 between the builder roller 50 and the winding core 20*a*. During the translational movement of the builder roller assembly 48, the builder roller 50 is pushed firmly toward the winding core 20*a* until the web 14 is pinched. The web 14 remains pinched while the guide assembly 112 is rotated about the winding core 20*a*. The force applied by the builder roller 50 against the pinched web 14 provides for a static friction that overcomes the pulling force applied by the action of the cinch roller 84 on the web 14 and winding core 20*a*. The force applied by the builder roller 50 is, preferably, minimized to reduce the risk of damage to the web 14. A separate brake (not shown) can alternatively or additionally be used for stopping web 14 movement, but use of the builder roller 50 alone is simpler.

In the illustrated embodiments, the linear velocity of the cinch roller 84 at the secondary nip 168 is the same or about the same as the linear velocity of the travel of the secondary nip 168 along the leading portion 152. This prevents differential movement of the leading portion 152 relative to the cinch roller 84, which could lead to damage to the leading portion 152. Like linear velocities of the revolving cinch roller 84 and the leading portion 152, are achieved by allowing the cinch roller 84 to freely revolve about the guide axis 122, relative to the axle 120, while holding the leading portion 152 and winding core 20*a* stopped. The free revolving of the cinch roller 84 also reduces friction against the leading portion 152 at the secondary nip 168. Alternatively, the cinch roller 84 can be powered, but this is adds complexity, since synchronization of the revolving about the guide axis 122 and rotation about the rotation axis is needed to prevent distortions of the web 14, such as scuffing, stretching, or bunching.

The leading portion 152 of the web 14 has a length that is less than the circumference of the winding core 20*a*. The leading portion 152 is long enough to extend from the primary nip 160 to the secondary nip 168 and, preferably, is long enough to extend beyond the secondary nip 168. The length and rotated position of the guide assembly 112 can be adjusted to accommodate curl or stiffness of the leading portion 152 that would tend to direct the free end 154 of the leading portion 152 away from the primary nip 160.

Figure 13:
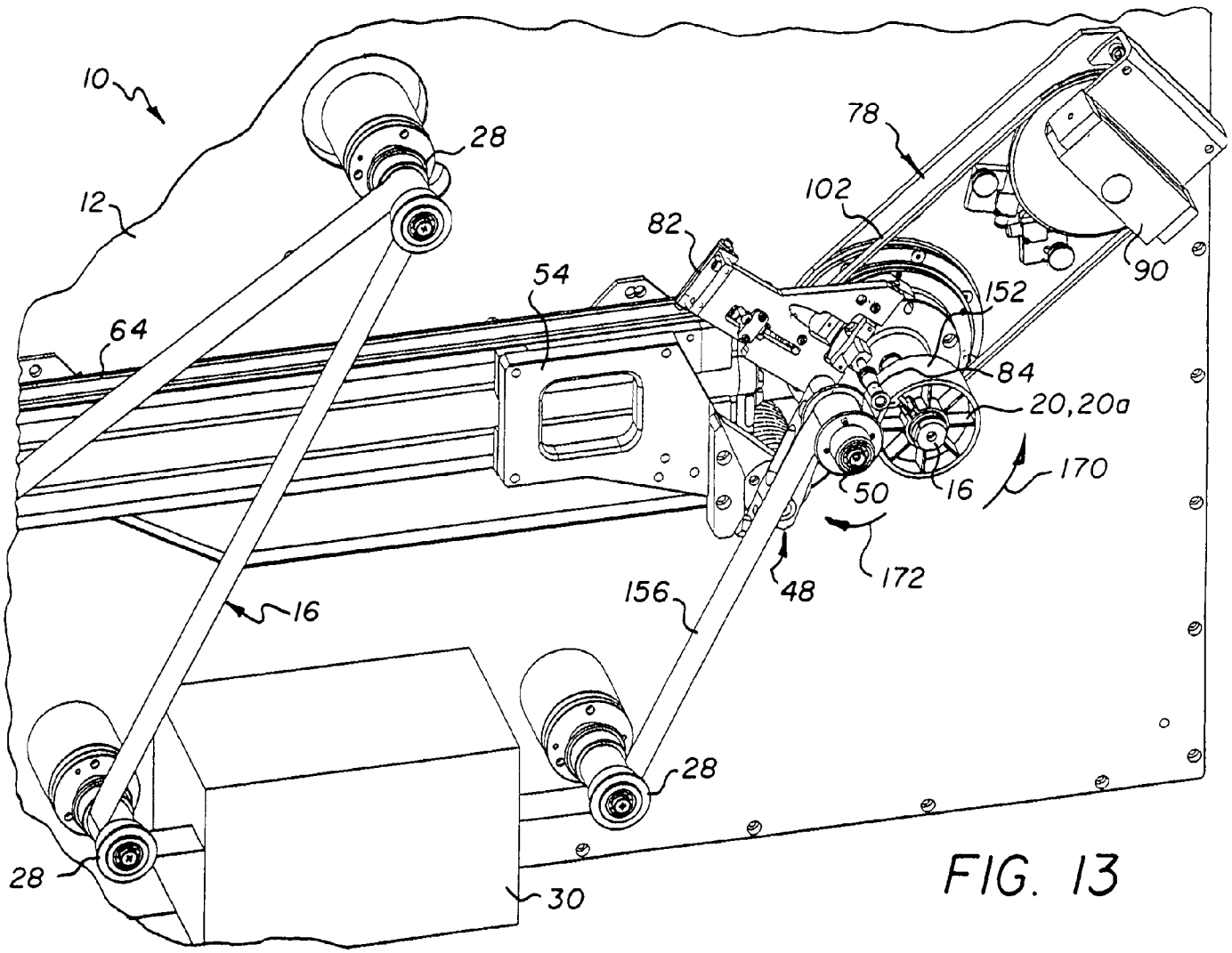
Figure 14:
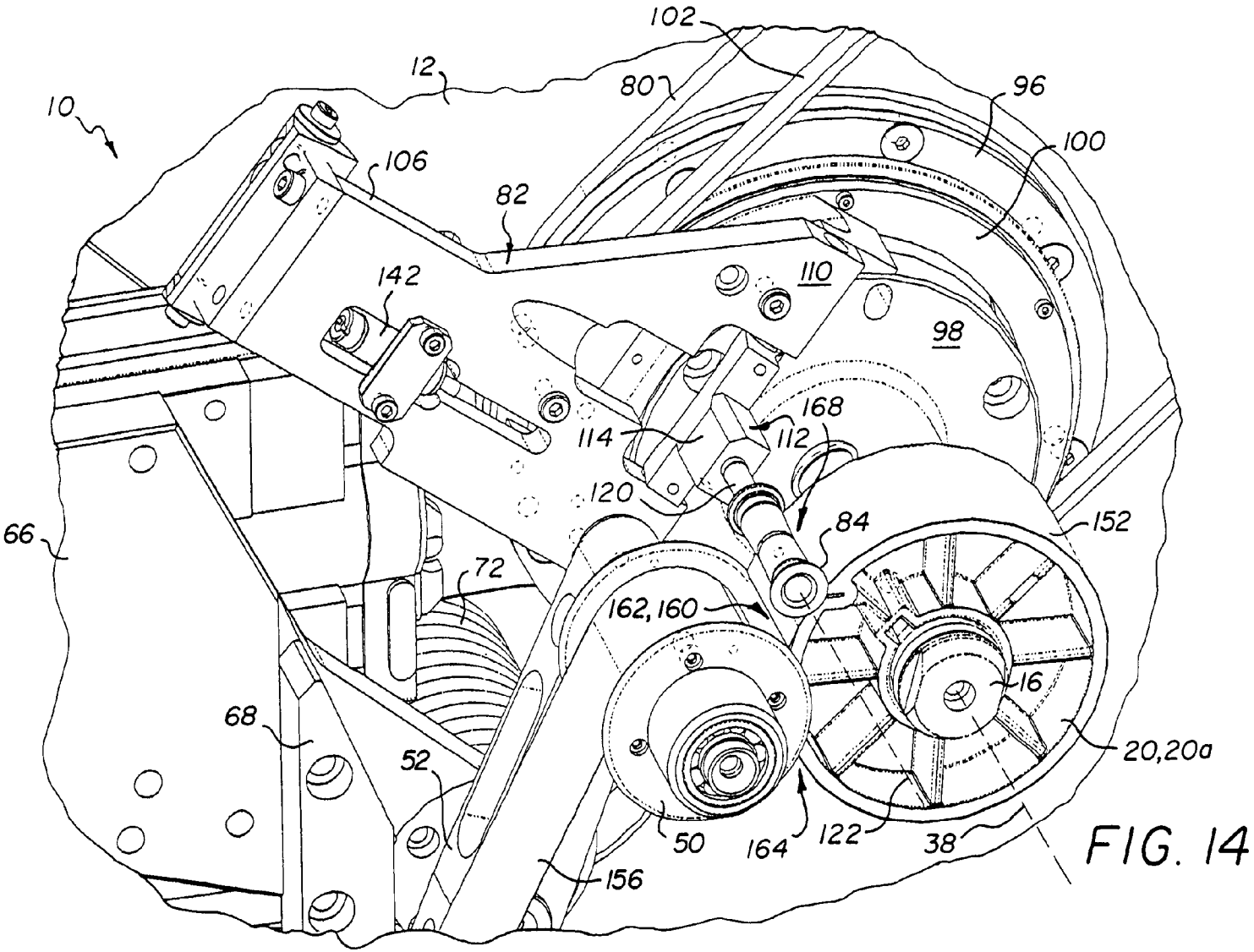
Figure 15:
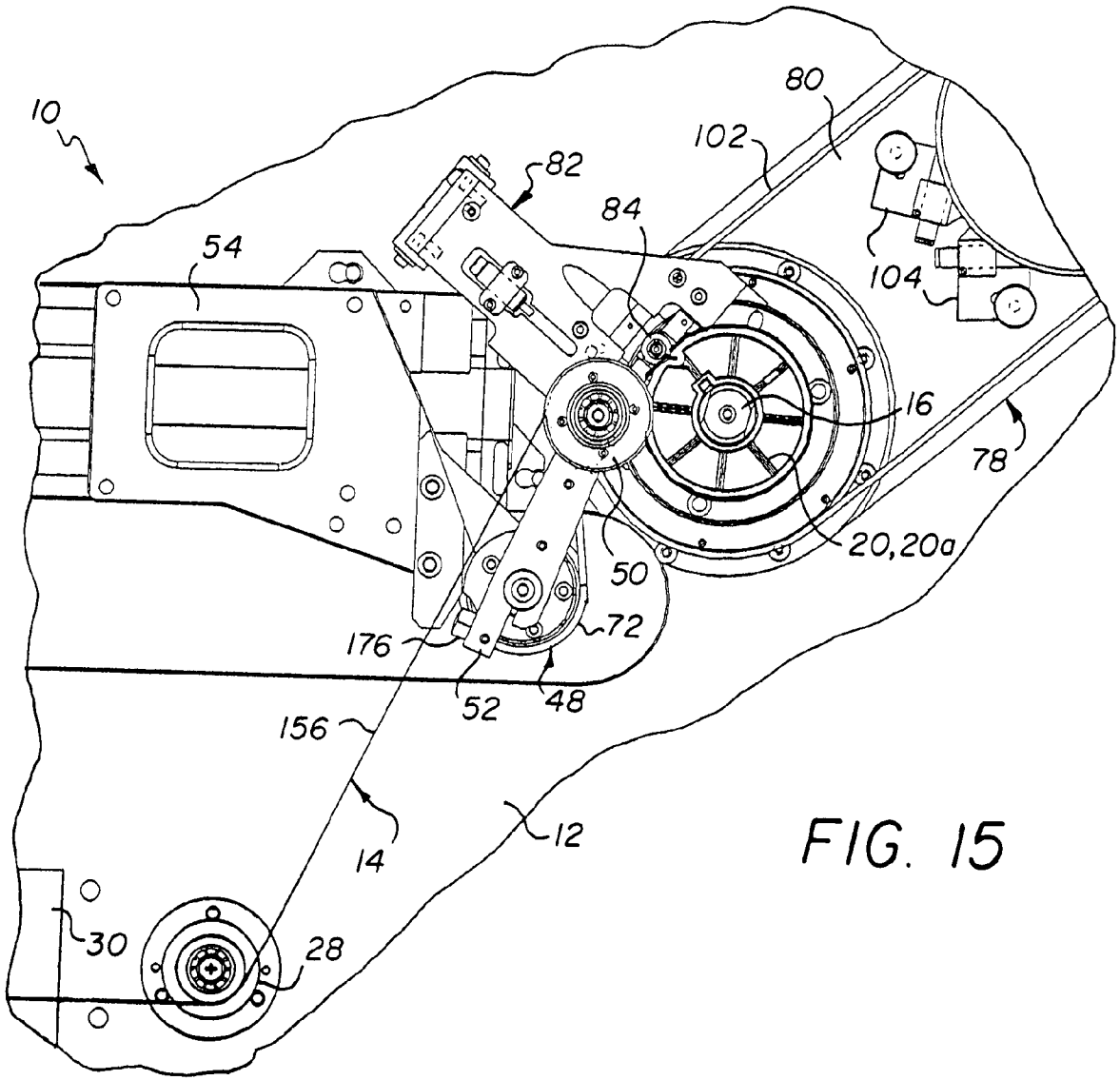
Figure 16:
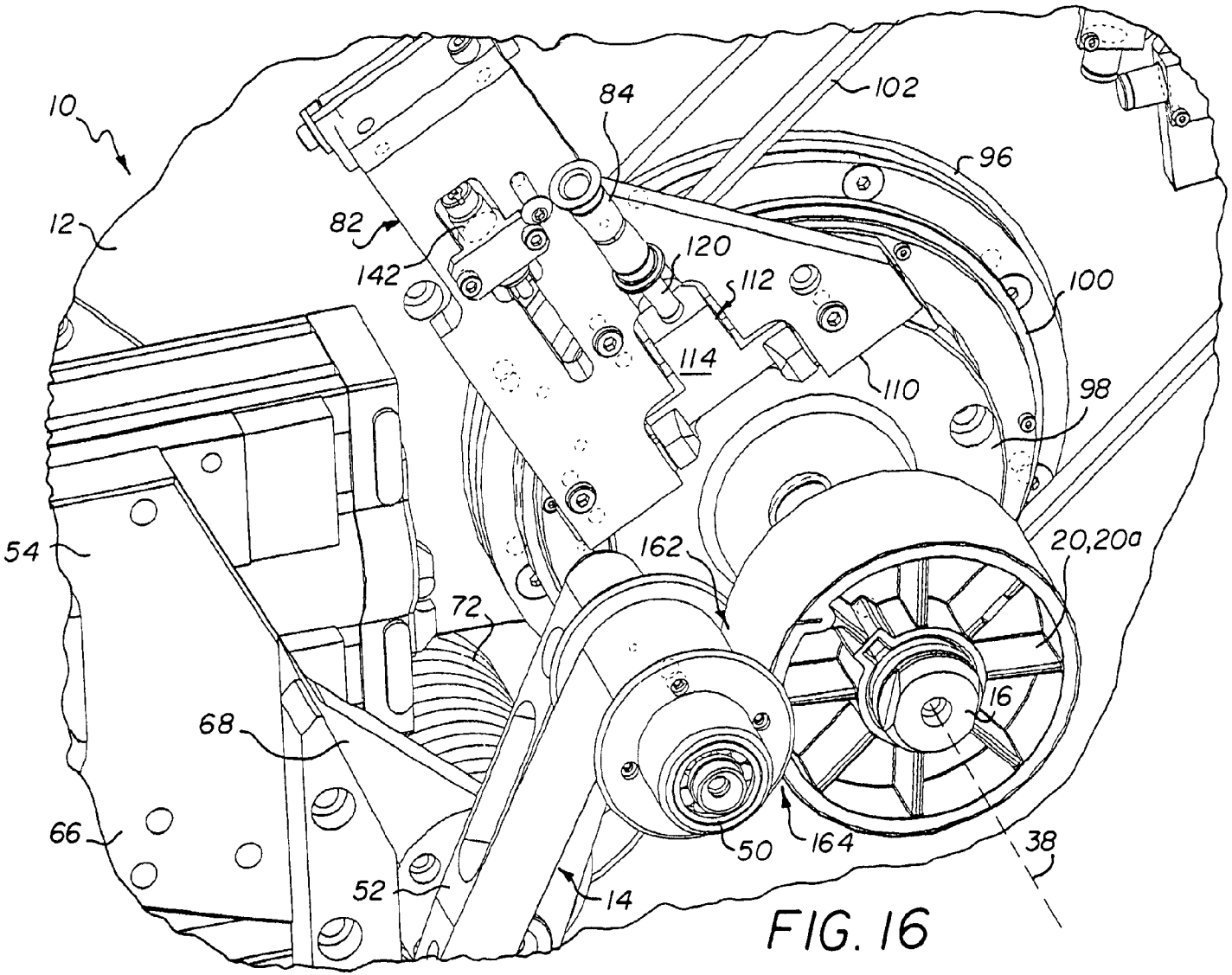
Figure 17:
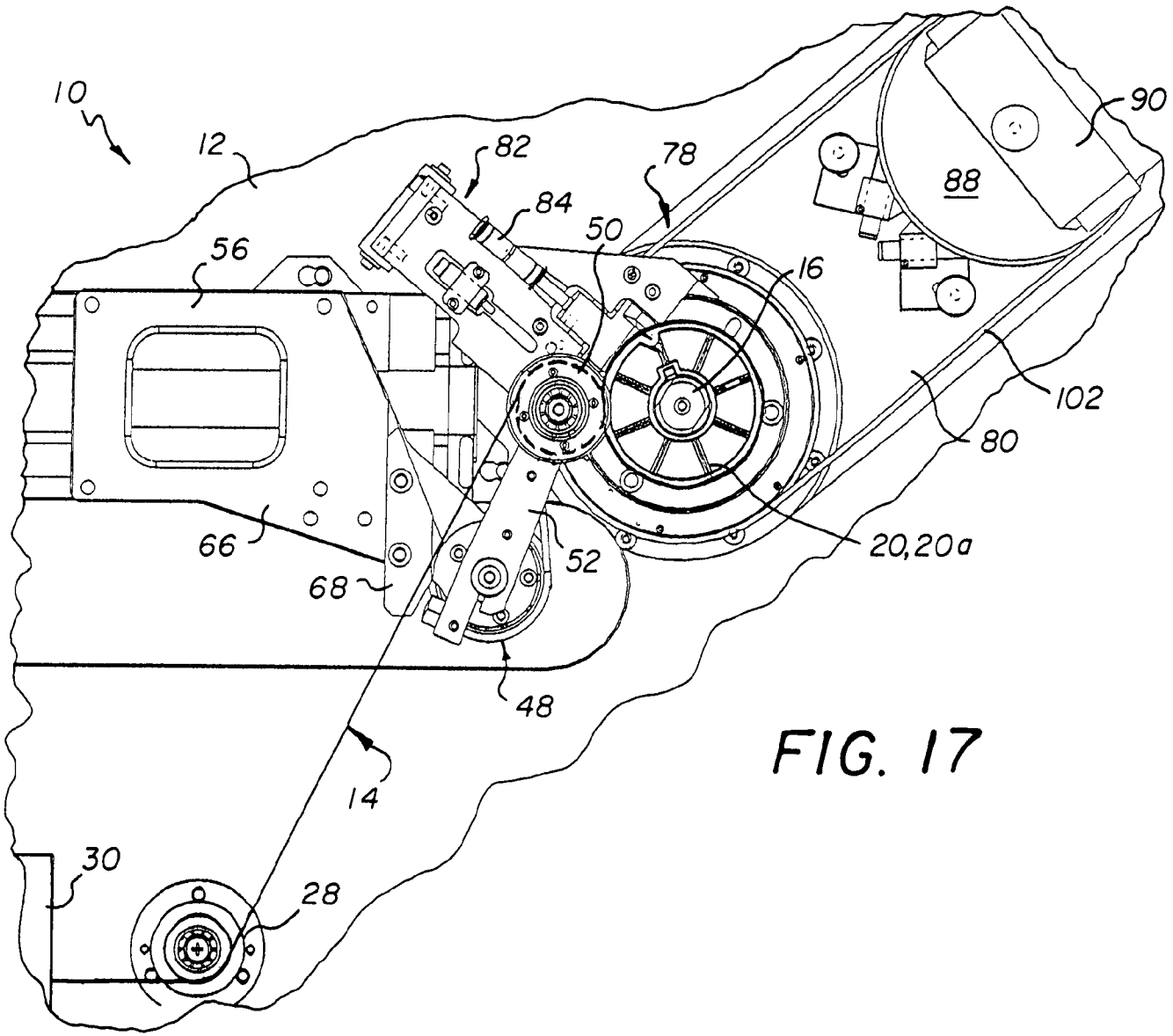
Figure 18:
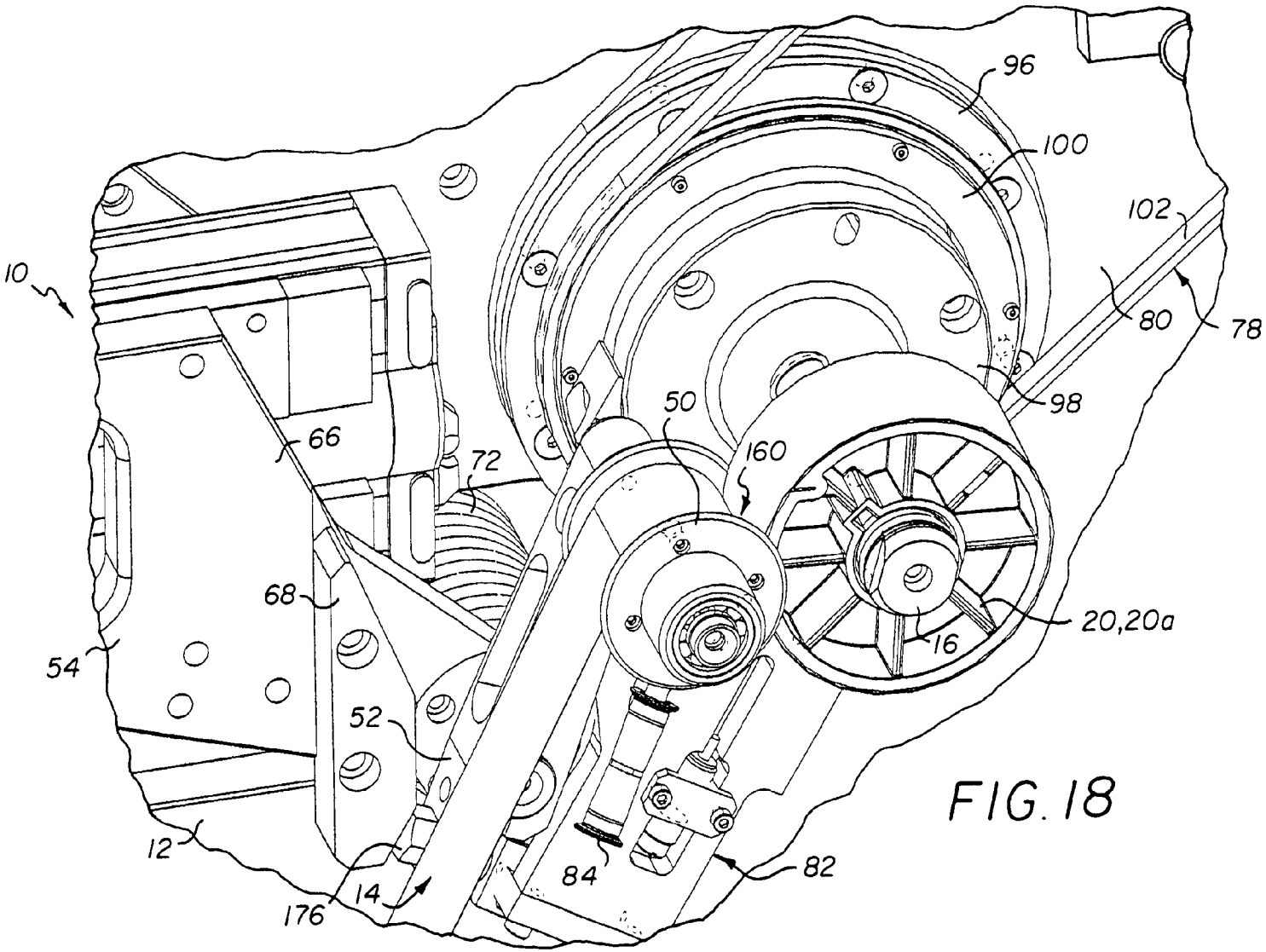
Figure 19:
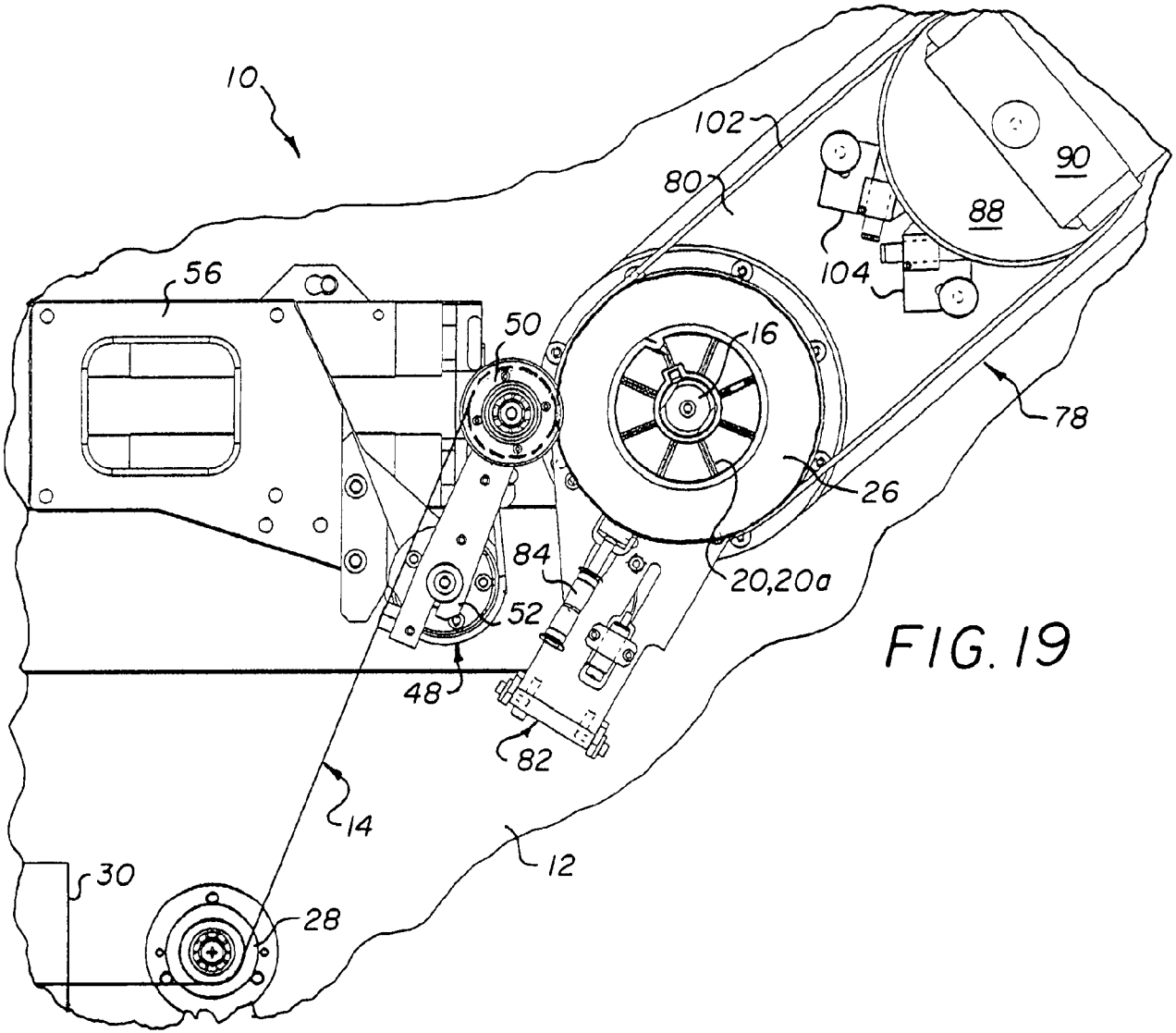
Figure 20:
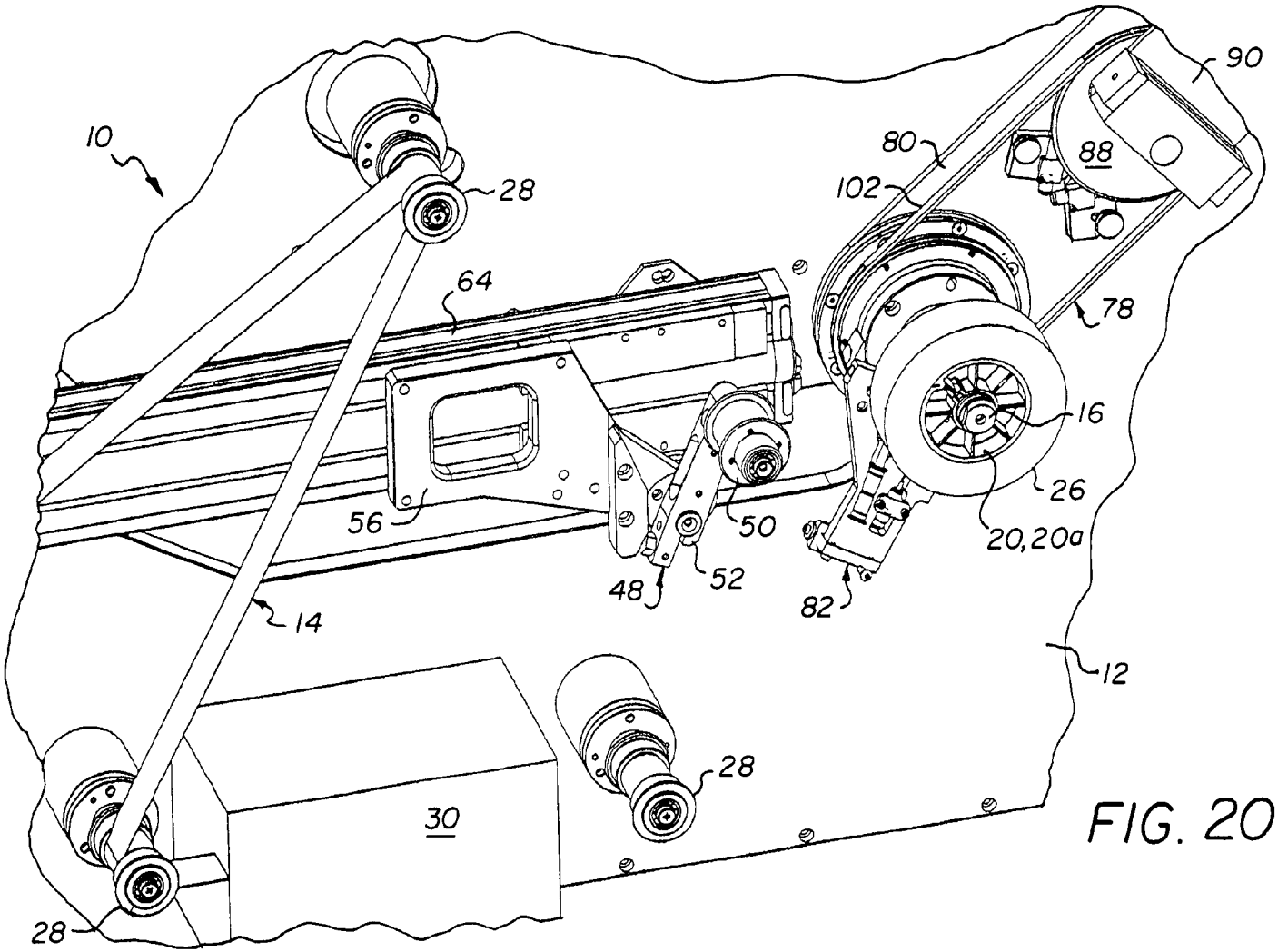

After the cinch roller 84 reaches the rotated position, the winding spindle 16 is rotated, which causes the winding core 20*a* and builder roller 50 to rotate in opposite directions of rotation, as indicated by arrows 170 and 172 in FIG. 13. This simultaneously advances the free end 154 of the leading portion 152 and the continuing portion 166 of the web 14 into the primary nip 160. At this time, the builder roller 50 can be in the same position, as that in which, the web 14 was initially pinched. Alternatively, the builder roller 50 can be retracted slightly to enlarge the primary nip 160 and reduce contact with the web 14 during further winding.

The rotation of the winding spindle 16 is continued until a plurality of turns of web 14 are wrapped over the leading portion 152. The leading portion 152 cinches to the winding core 20*a* after a turn or two.

The gimbaling of the cinch roller 84 to the axle allows the cinch roller 84 to pivot back and forth relative to the guide axis 122 while the leading portion 152 of the web 14 is bent against the winding core 20*a*. This accommodates nonuniformity in the cross-section of the winding core 20*a* and, more importantly, allows the cinch roller 84 to pivot during the winding of the first few turns of web 14. This pivoting of the cinch roller 84 at the gimbal allows the cinch roller 84 to remain parallel to the web 14 at the secondary nip 168, while the first few turns of web 14 are wrapped around the winding core 20*a*. If a non-gimbaled cinch roller 84 is used, then pressure on one side of the growing web roll 26 increases as the web 14 is wound, due to the change in diameter causes by the turns of web 14. With some web 14 materials, this is unimportant, but with film, there is a risk of pressure marking if a non-gimbaled cinch roller 84 is used.

At some time after cinching, the guide assembly 112 is pivoted back from the first orientation into the second orientation. (See FIGS. 16–17.) This eliminates the secondary nip 168. The carrier 82 is pivoted back to the start position, during and/or after pivoting of the guide assembly 112 into the second orientation. (See FIGS. 18–19) Winding is continued until a desired web roll 26 has been wound. The web 14 is then cut using the cutter 30 and the completed web roll 26 is removed. (See FIGS. 19–20.)

If the web roll 26 is large, then the builder roller assembly 48 is backed away from the winding axis 38 during winding. The builder roller assembly 48 begins winding in the forward position, and is then moved through a sequence of intermediate winding positions until the web roll 26 is completed.

Figure 31:
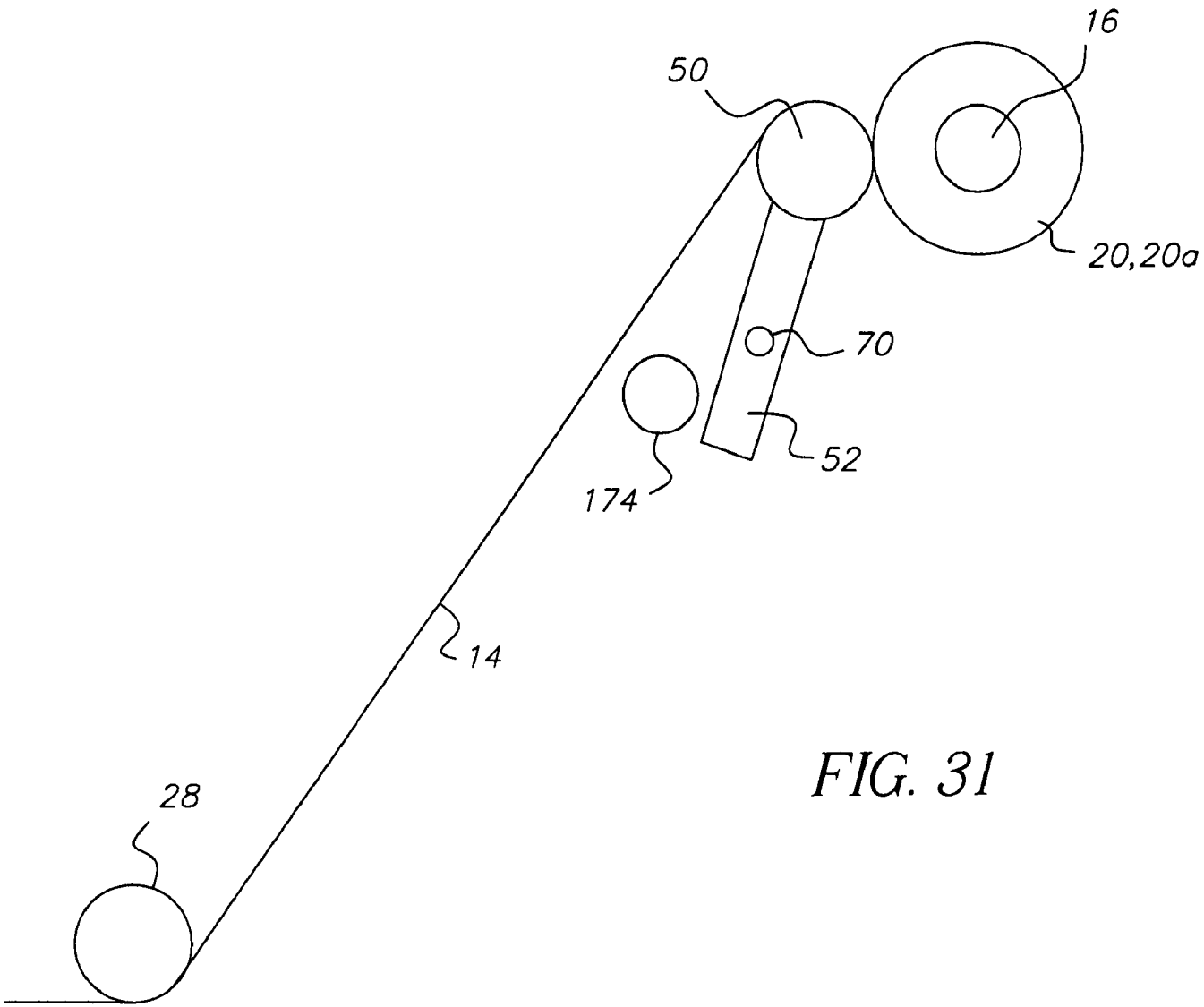
FIGS. 31–33 are diagrammatical front views illustrating the operation of the builder roller of the apparatus of FIG. 1 during winding in a contact (pressure bearing) mode.
Figure 32:
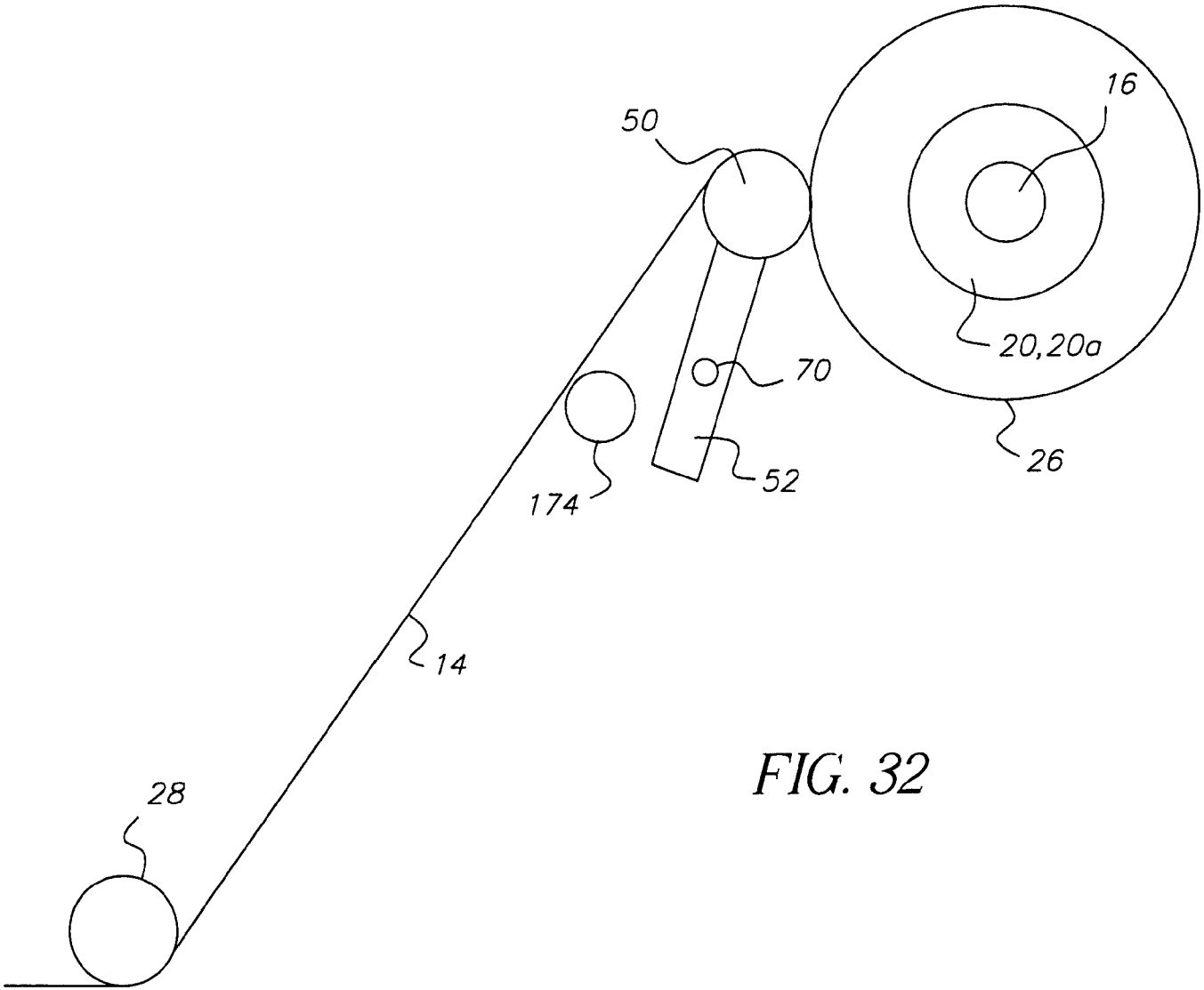
Figure 33:
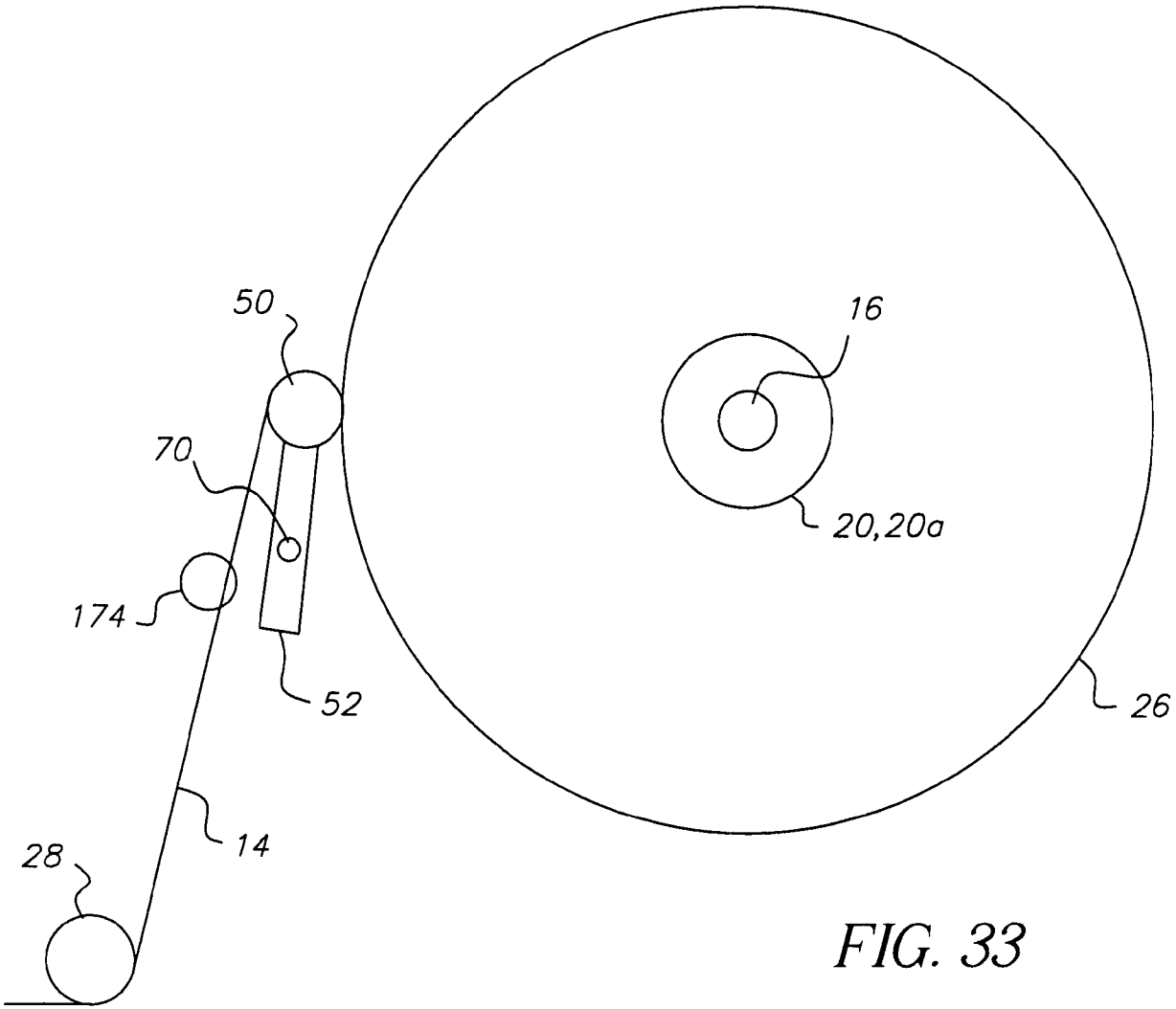

Referring now particularly to FIGS. 31–33, in particular embodiments the biaser 72 is a constant-force coil spring. The coil spring 72 applies a biasing force that varies little over the range of movement of the arm 52. The variation in force is preferably less than 5 percent and more preferably 2 percent or less. The constant-force spring allows the builder roller 50 to apply a substantially constant force at the primary nip 160 throughout winding. The force applied by the builder roller 50 remains constant even as the tension on the web 14 changes as the web roll 26 grows.

As long as the builder roller 50 remains in contact with the web 14 at the primary nip 160 and the arm 52 is pivoted within a range of constant force for the spring, then the force applied by the builder roller 50 is also decoupled from the position of the builder roller assembly 48 relative to the winding axis 38. This allows the translational movement of the builder roller assembly 48 during winding to be standardized based upon the rate of web growth at a particular winding rate. This also allows builder roller 50 tension to be quickly and easily optimized for a particular web material and other winding conditions, since builder roller position during winding does not need to be considered.

Figure 34:
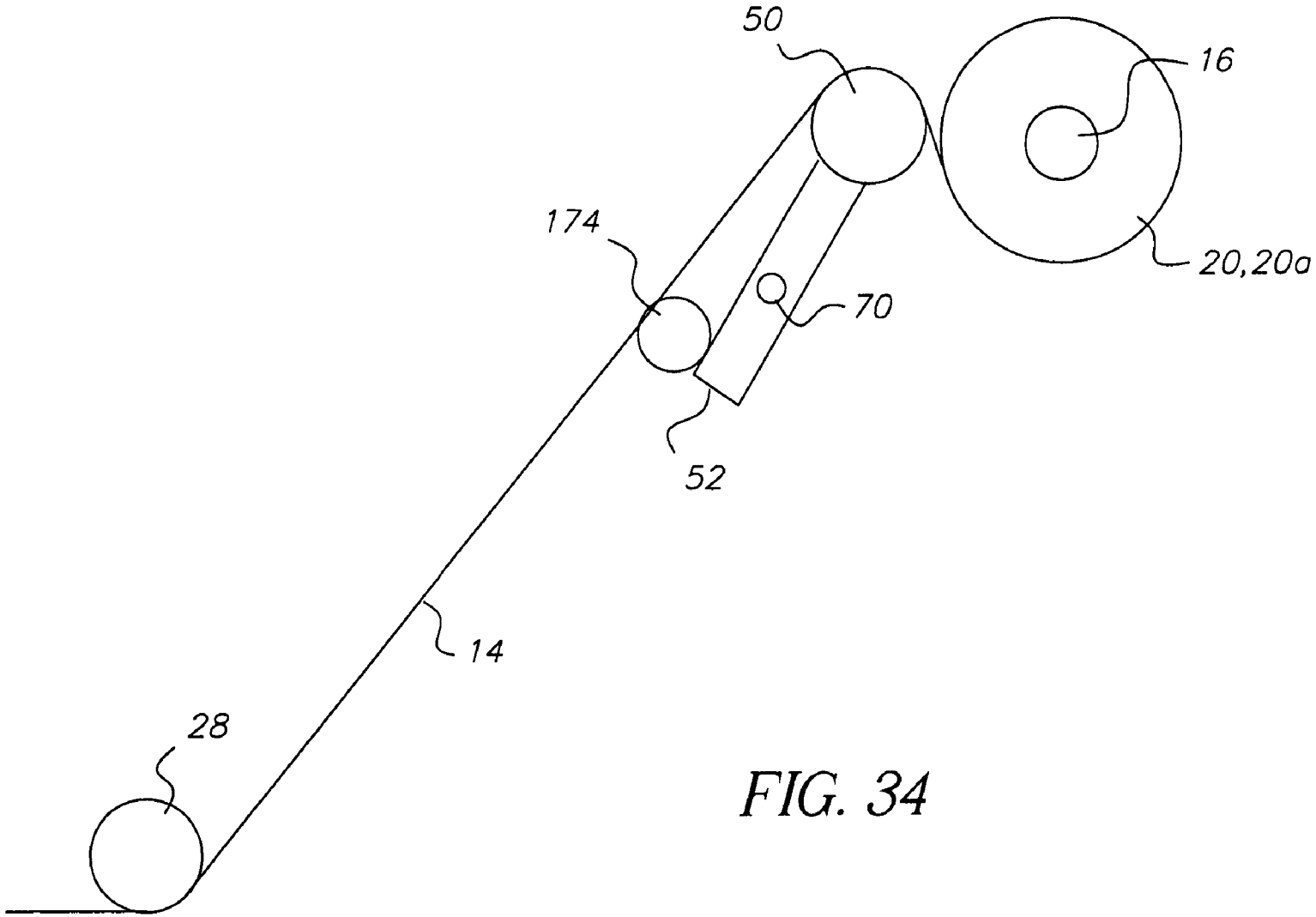
FIGS. 34–36 are diagrammatical front views illustrating the operation of the builder roller of the apparatus of FIG. 1 in a no contact (pressure free) mode.
Figure 35:
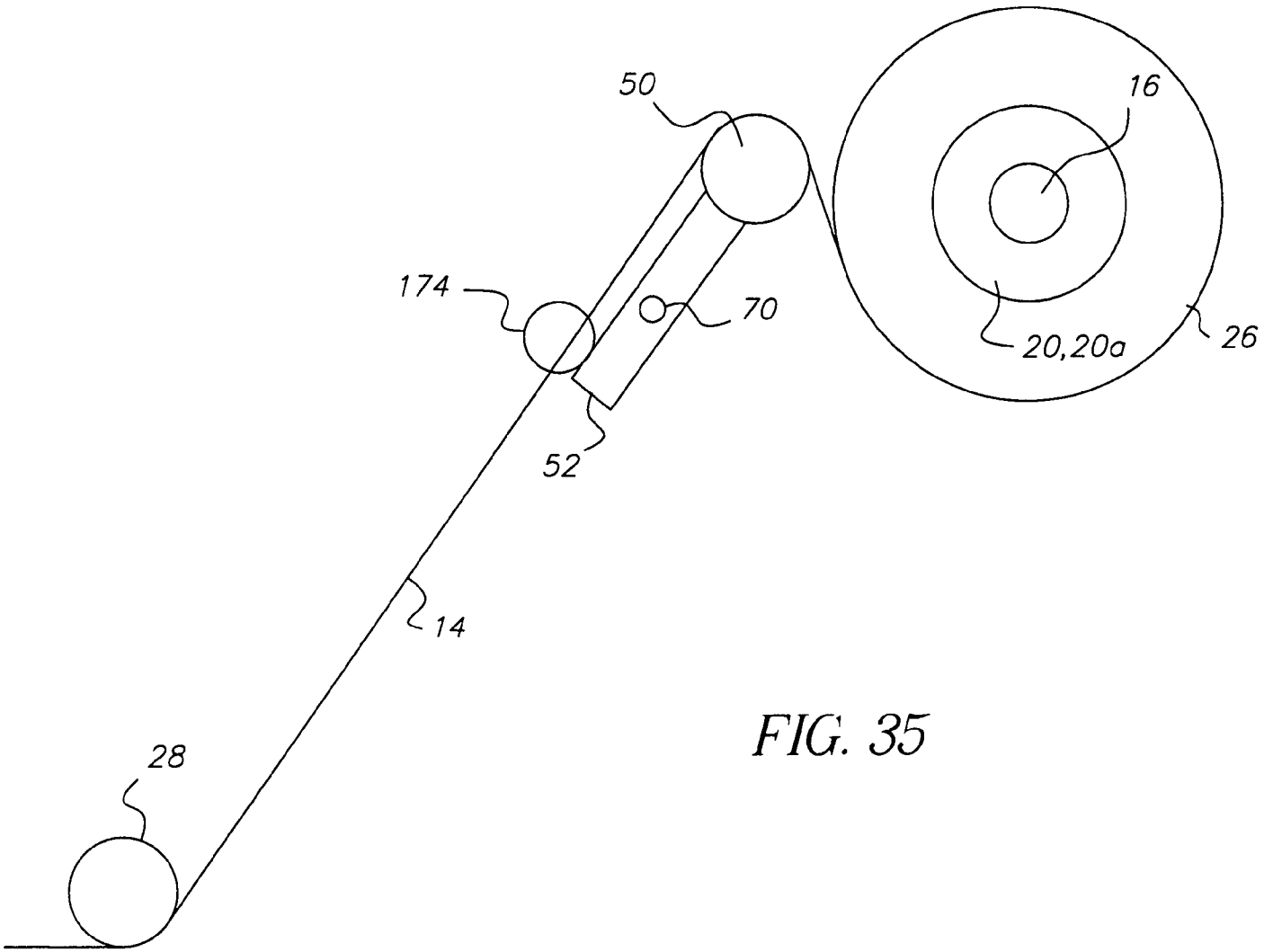
Figure 36:
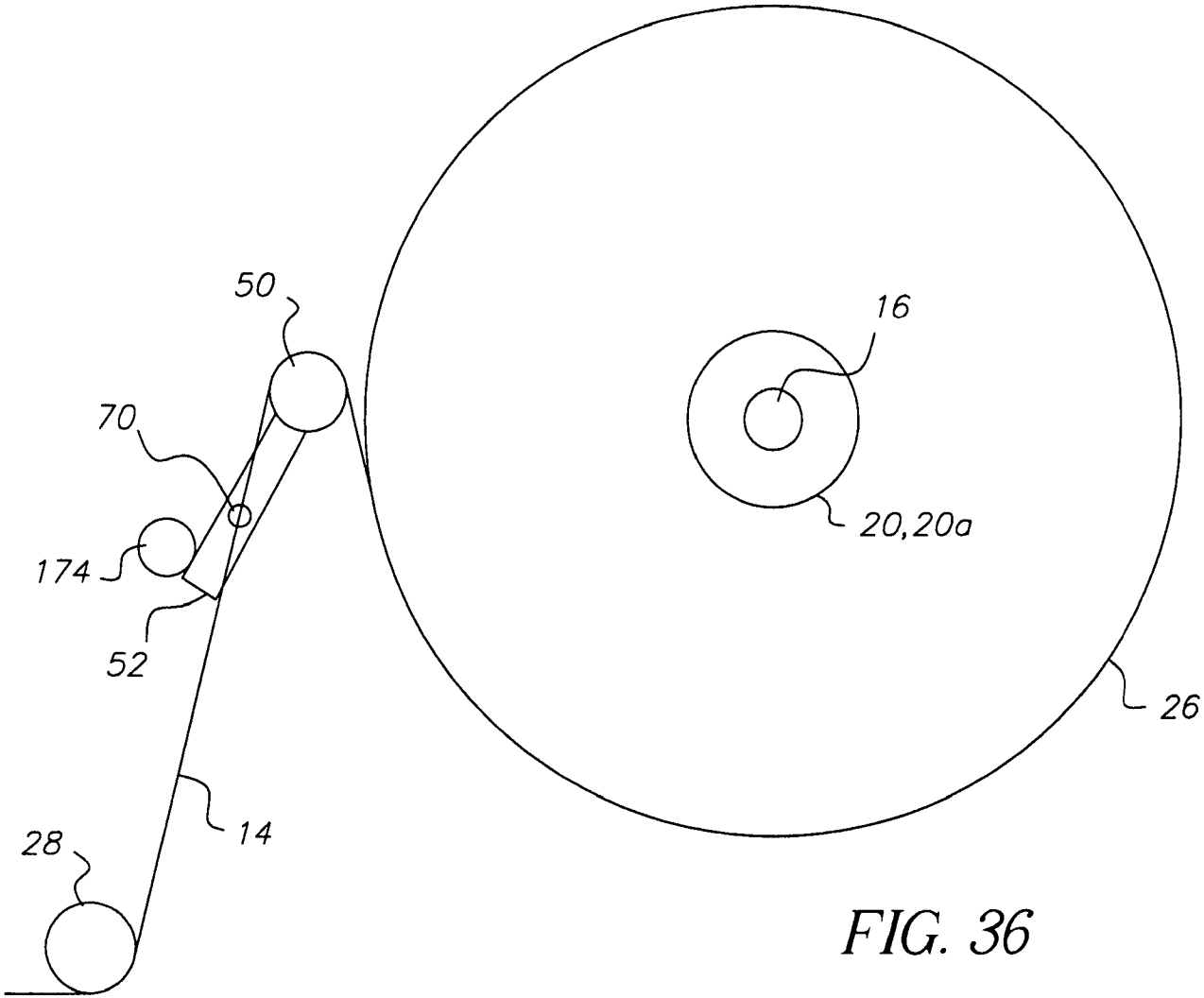

Referring now particularly to FIGS. 34–36, in a particular embodiment, the builder roller assembly 48 is backed away from the winding axis 38 during winding, to the extent that the builder roller 50 no longer contacts the web roll 26. The spring causes the arm 52 to pivot until a stop nut 176 on the arm 52 reaches a stop 174, which is fixed to the carriage 54. In this case, the builder roller assembly 48 is moved during winding based upon a rate of web roll 26 growth, so as to maintain a desired spacing between the builder roller 50 and the web roll 26.

Features of the invention can be varied to meet particular requirements. For example, it may be convenient to eliminate flanges on the builder roller 50 and cinch roller 84, if the winding core 20*a* is flanged. Likewise, the apparatus 10 can be modified to utilize the builder roller to dispense a liquid or powdered material onto the web 14 or otherwise treat the web 14. For example, the builder roller can emboss or can apply an overcoat or adhesive layer or inked pattern (using a patterned builder roller).

The invention has been described in detail with particular reference to certain preferred embodiments thereof, but it will be understood that variations and modifications can be effected within the spirit and scope of the invention.

What is claimed is:

1. A winding method comprising the steps of:

forming a primary nip against a web, said primary nip defining a continuing portion of said web on an infeed side of said primary nip and a leading portion of said web on an outfeed side of said primary nip, said leading portion having a free end;

forming a secondary nip against said leading portion;

following said forming of said nips, traveling said secondary nip along said leading portion, from a first position adjoining said primary nip on said outfeed side to a second position adjoining said primary nip on said infeed side;

following said traveling, simultaneously advancing said continuing portion and said free end of said leading portion into said primary nip; and holding said web stopped during said traveling.

2. The method of claim 1 further comprising during said traveling, bending said leading portion into a loop.

3. The method of claim 1 wherein said forming of said secondary nip follows said forming of said primary nip.

4. The method of claim 1 further comprising the steps of:

winding said continuing portion in a plurality of turns over said leading portion, following said advancing; and during said winding, eliminating said secondary nip.

5. The method of claim 1 wherein said traveling further comprises rotating said secondary nip about a winding axis parallel to the longest dimensions of said primary and secondary nips.

6. The method of claim 5 wherein said rotating is through an angle of greater than 180 degrees.

7. The method of claim 5 wherein said rotating is through an angle of 270 degrees.

8. The method of claim 1 wherein said forming of said primary nip further comprises pinching said web.

9. A web winding method comprising the steps of:

pinching a stopped web at a primary nip between a builder roller and a winding core, said primary nip defining a continuing portion of said web on an infeed side of said primary nip and a leading portion of said web on an outfeed side of said primary nip;

during said pinching, forming a secondary nip between said winding core and a cinch roller;

during said pinching, traveling said secondary nip in an incomplete orbit around said winding core from a position adjacent said outfeed side of said primary nip to a position adjacent said infeed side of said primary nip, said traveling of said secondary nip rolling said leading portion around said winding core;

winding said continuing portion in a plurality of turns over said leading portion, following said traveling; and during said winding, eliminating said secondary nip; and further comprising the steps of:

holding said web stopped, during said traveling; and following said traveling and prior to said winding, simultaneously advancing said continuing portion and a free end of said leading portion into said primary nip.

10. The method of claim 9 wherein said web has a pair of opposed longitudinal edges and said traveling further comprises contacting only said edges with said cinch roller.

11. A web winding method comprising the steps of:

advancing a predetermined length of a leading portion of a web out of a web supply;

draping said leading portion over a builder roller;

following said draping, translating said builder roller into the proximity of a winding core;

pinching said web at a primary nip between said builder roller and said winding core, said primary nip defining a continuing portion of said web on an infeed side of said primary nip and a leading portion of said web on an outfeed side of said primary nip;

during said pinching, forming a secondary nip between said winding core and a cinch roller;

during said pinching, traveling said secondary nip in an incomplete orbit around said winding core to roll said leading portion around said winding core;

winding said continuing portion in a plurality of turns over said leading portion, following said traveling; and during said winding, eliminating said secondary nip.

12. An apparatus for winding a web, said apparatus comprising:

a winding spindle rotatable about a winding axis;

a builder roller rotatable about a builder roller axis parallel to said winding axis, said builder roller defining an infeed arc and an outfeed arc;

an axle defining a guide axis, said axle being pivotable between a first orientation wherein said guide axis parallels said winding axis and a second orientation wherein said guide axis is transverse to said winding axis, said axle being movable in said first orientation, in an incomplete orbit about said winding spindle from a start position in said infeed arc to a rotated position in said outfeed arc, said axle being adjacent said builder roller in said initial and rotated positions, said axle being returnable from said rotated position to said start position, in said second orientation; and a cinch roller rotatable about said guide axis.

13. The apparatus of claim 12 wherein said cinch roller is gimballed to said axle.

14. The apparatus of claim 12 wherein said cinch roller has a pair of opposed flanges and said cinch roller is gimballed to said axle midway between said flanges.

15. The apparatus of claim 12 wherein said builder roller is translatable toward and away from said winding axis between a standby position and a forward position.

16. The apparatus of claim 15 further comprising a biaser biasing said builder roller toward said winding axis when said builder roller is in said forward position.

17. The apparatus of claim 12 further comprising a rotary drive operatively connected to said winding spindle and wherein said builder roller is freely rotatable.

18. An apparatus for winding a web, said apparatus comprising:

a winding spindle rotatable about a winding axis;

a core mounted on and rotatable with said winding spindle;

a builder roller located in a forward position relative to said core, said builder roller being rotatable about a builder roller axis parallel to said winding axis, said core and said builder roller defining a primary nip having an infeed side and an outfeed side;

an axle rotatable about a guide axis, said axle being pivotable between a first orientation paralleling said winding axis and a second orientation transverse to said winding axis, said axle being movable in said first orientation, in an incomplete orbit about said winding core from a start position adjoining said builder roller on said outfeed side, through a plurality of intermediate positions, to a rotated position adjoining said builder roller on said infeed side, said axle being returnable from said rotated position to said start position, in said secondary orientation; and a cinch roller rotatable about said guide axis, said cinch roller and said builder roller defining a secondary nip when said axle is in said start, intermediate, and finish positions.

19. The apparatus of claim 18 wherein said cinch roller is gimballed to said axle.

20. The apparatus of claim 18 wherein said cinch roller has a pair of opposed flanges and said cinch roller is gimballed to said axle midway between said flanges.

21. The apparatus of claim 18 wherein said builder roller is translatable toward and away from said winding axis between a standby position and said forward position.

22. A web winding method comprising the steps of:

pinching a web at a primary nip between a builder roller and a winding core, said primary nip defining a continuing portion of said web on an infeed side of said primary nip and a leading portion of said web on an outfeed side of said primary nip;

during said pinching, forming a secondary nip between said winding core and a cinch roller;

during said pinching, traveling said secondary nip in an incomplete orbit around said winding core from a position adjacent said outfeed side of said primary nip to a position adjacent said infeed side of said primary nip, said traveling of said secondary nip rolling said leading portion around said winding core;

following said forming, pivoting said cinch roller about a gimbal to maintain said secondary nip parallel to said web;

winding said continuing portion in a plurality of turns over said leading portion, following said traveling.

23. The method of claim 22 further comprising, during said winding, eliminating said secondary nip.

* * * * *